US010642201B2

(12) United States Patent
Ohnishi

(10) Patent No.: US 10,642,201 B2
(45) Date of Patent: May 5, 2020

(54) IMAGE FORMING APPARATUS THAT CONTROLS ROTATION OF A ROTATING UNIT AND A HEATING PROCESS OF A HEATING PORTION

(71) Applicant: CANON FINETECH NISCA INC., Misato-shi (JP)

(72) Inventor: Takahiro Ohnishi, Kashiwa (JP)

(73) Assignee: Canon Finetech Nisca Inc., Misato (JP)

( * ) Notice: Subject to any disclaimer, the term of this patent is extended or adjusted under 35 U.S.C. 154(b) by 0 days.

(21) Appl. No.: 16/124,972

(22) Filed: Sep. 7, 2018

(65) Prior Publication Data

US 2019/0079436 A1 Mar. 14, 2019

(30) Foreign Application Priority Data

Sep. 8, 2017 (JP) ..... 2017-172657

(51) Int. Cl.
*G03G 15/20* (2006.01)
*G03G 15/00* (2006.01)

(52) U.S. Cl.
CPC ..... *G03G 15/2021* (2013.01); *G03G 15/2017* (2013.01); *G03G 15/2028* (2013.01); *G03G 15/2046* (2013.01); *G03G 15/2064* (2013.01); *G03G 15/50* (2013.01); *G03G 2221/1657* (2013.01)

(58) Field of Classification Search
None
See application file for complete search history.

(56) References Cited

U.S. PATENT DOCUMENTS 5,708,920 A * 1/1998 Ohnishi ..... G03G 15/2039 399/69
6,185,388 B1 * 2/2001 Yamamoto ..... H05B 1/0241 219/216
2005/0207770 A1 * 9/2005 Nihonyanagi ..... G03G 15/2025 399/67
2007/0230982 A1 * 10/2007 Hori ..... G03G 15/2039 399/69

(Continued)

FOREIGN PATENT DOCUMENTS

JP H11-344894 A 12/1999
JP 2001-228744 A 8/2001

*Primary Examiner* — Victor Verbitsky
(74) *Attorney, Agent, or Firm* — Venable LLP

(57) ABSTRACT

An image forming apparatus includes a controller that changes a rotating unit between a rotating state and a stop state, and a temperature of a heating portion to be a predetermined temperature by performing a heating operation. The controller performs, in order, a non-heating rotating process of setting the rotating unit in the rotating state, without controlling the temperature of the heating portion, after fixing the toner image on the recording material, a heating rotating process of controlling the temperature of the heating portion to be the predetermined temperature while setting the rotating unit in the rotating state, and a heating stopping process of controlling the temperature of the heating portion to be the predetermined temperature while setting the rotating unit in the stop state. The controller stops the heating operation in the heating stopping process after a predetermined period.

16 Claims, 20 Drawing Sheets

(56) References Cited

U.S. PATENT DOCUMENTS

| | | | | |
|---|---|---|---|---|
| 2015/0055995 | A1* | 2/2015 | Yamashita | G03G 15/2057 399/333 |
| 2015/0147077 | A1* | 5/2015 | Kurokawa | G03G 15/205 399/69 |

* cited by examiner

FIG. 11

| | FILM TEMPERATURE INSIDE NIP (°C) | FILM TEMPERATURE OUTSIDE NIP (°C) | TEMPERATURE DIFFERENCE INSIDE AND OUTSIDE NIP (°C) | EXISTENCE OF PERMANENT DEFORMATION (RECESS) OF FILM WHEN MOTOR IS DRIVEN AT LEFT CONDITIONS | EFFECT |
|---|---|---|---|---|---|
| COMPARATIVE EXAMPLE | 190 | 50 | 140 | YES | × |
| FIRST EMBODIMENT | 190 | 153 | 37 | NO | ○ |

FIG. 15

| | FILM TEMPERATURE INSIDE NIP (°C) | FILM TEMPERATURE OUTSIDE NIP (°C) | TEMPERATURE DIFFERENCE INSIDE AND OUTSIDE NIP (°C) | EXISTENCE OF PERMANENT DEFORMATION (RECESS) OF FILM WHEN MOTOR IS DRIVEN AT LEFT CONDITIONS | EFFECT |
|---|---|---|---|---|---|
| COMPARATIVE EXAMPLE | 190 | 20 | 170 | YES | × |
| SECOND EMBODIMENT | 190 | 150 | 40 | NO | ○ |

IMAGE FORMING APPARATUS THAT CONTROLS ROTATION OF A ROTATING UNIT AND A HEATING PROCESS OF A HEATING PORTION

This application claims the benefit of Japanese Patent Application No. 2017-172657, filed Sep. 8, 2017, which is hereby incorporated by reference herein in its entirety.

BACKGROUND OF THE INVENTION

Field of the Invention

The present invention relates to an image forming apparatus, such as a copying machine and a printer.

Description of Related Art

An image forming apparatus, such as a copying machine of an electrophotographic system and a printer, is provided with a fixing device. A film heating type fixing device is provided with a fixing film that rotates along a film guide, a heater that is disposed inside the fixing film and heats the fixing film, and a pressure roller in which a heat-resistant elastic layer is formed on a metal core of aluminum or iron.

In such a fixing device, the fixing film is pressed against the pressure roller by a spring, or the like, and a recording material bearing an unfixed toner passes through a fixing nip portion formed by the pressing so that the recording material is heated and pressed. Accordingly, the unfixed toner is fixed to the recording material. A length of a heating member provided in the heater in the longitudinal direction is set to be greater than a maximum size of the recording material to be used. When the recording material passes through the fixing nip portion, a non-passage area through which the recording material does not pass increases in temperature.

When a small-size recording material passes through the fixing nip portion and then a large-size recording material passes through the fixing nip portion, the large-size recording material passes through the non-passage area, which increases in temperature when the small-size recording material passes through the fixing nip portion. At this time, since a temperature increases excessively, a high-temperature offset, in which the toner on the recording material adheres to the outer peripheral surface of the fixing film, is generated.

In order to prevent such a high-temperature offset, a cooling operation of setting a temperature of the heater to be flat in the longitudinal direction is performed after an image forming operation ends. As an example of the cooling operation, a post-rotation of rotating the pressure roller and the fixing film, while turning off the heater after the end of the image forming operation, is performed.

In Japanese Patent Laid-Open No. 11-344894, the temperature of the heater is controlled until the fixing nip portion is heated to the toner softening point or more after the post-rotation of the pressure roller and the fixing film after the end of the image forming operation. Accordingly, since an accumulation of dirt of the toner on the pressure roller is prevented, it is possible to prevent the recording material from being wound on the pressure roller or dirt from accumulating on the recording material.

In Japanese Patent Laid-Open No. 2001-228744, the supply of a current to the heater is stopped during the post-rotation of the pressure roller and the fixing film. At this time, a decrease in temperature of the heater is detected by a fixing thermistor at an arbitrary time after the supply of the current to the heater is stopped. Then, a temperature control time or a control temperature for the pressure roller and the fixing film in a stop state is changed in response to the detection temperature of the fixing thermistor. Accordingly, since an abnormal increase in temperature of the pressure roller due to the post-heating is prevented, a cleaning defect on the surface of the pressure roller due to insufficient cooling of the toner of the fixing nip portion is prevented.

When the recording material having a short length in a direction orthogonal to the conveying direction compared to the length of the heating member of the heater in the longitudinal direction passes through the fixing nip portion, a temperature unevenness occurs in the longitudinal direction of the fixing nip portion. For this reason, in order to cool the fixing nip portion until a temperature distribution in the longitudinal direction of the heater becomes flat after the recording material passes through the fixing nip portion, the heater is turned off and the post-rotation is performed. Then, the temperature of the fixing film or the pressure roller decreases on the whole.

As in Japanese Patent Laid-Open No. 11-344894 and Japanese Patent Laid-Open No. 2001-228744, the heater 19 is energized again to be heated while the driving of a pressure roller 21 is stopped, as illustrated in FIG. 20A, after the post-rotation for cooling the fixing nip portion ends. Then, only a fixing film 15 inside a fixing nip portion 22, formed by the fixing film 15 and the pressure roller 21, thermally expands and the fixing film 15 outside the fixing nip portion 22 does not thermally expand. For this reason, an expansion unevenness is generated in the circumferential direction of the fixing film 15 due to the thermal expansion portion and the non-thermal expansion portion in the circumferential direction of the fixing film 15.

Since the expansion unevenness is generated in the circumferential direction of the fixing film 15, thermal stress is applied to the fixing film 15 so that a local distortion is generated in the fixing film 15. In this state, when the pressure roller 21 is driven by starting the image forming operation, a result is obtained as illustrated in FIG. 20B. In FIG. 20B, the distorted fixing film 15, which is not locally maintained in a circular shape, is pulled in the rotation direction (the clockwise direction of FIG. 20B) by the pressure roller 21. Due to the rotational driving of the pressure roller 21, pulling stress in the rotation direction of the pressure roller 21 is applied to the locally distorted fixing film 15. Accordingly, since the recess portion 15*a* is formed by the permanent deformation of the fixing film 15, the fixing device 27 has a short life.

SUMMARY OF THE INVENTION

According to one aspect, the present invention provides an image forming apparatus including a fixing portion that heats and fixes an unfixed image formed on a recording medium while nipping and conveying the recording medium by a rotation of a rotating member during an image forming operation, and a controller that rotates the rotating member without heating the rotating member until a temperature at a different position in the fixing portion falls within a predetermined range, and then heats the rotating member in a stop state after heating the rotating member while rotating the rotating member.

Further features of the present invention will become apparent from the following description of exemplary embodiments with reference to the attached drawings.

BRIEF DESCRIPTION OF THE DRAWINGS

FIG. 11 is a diagram describing an effect for a recess portion formed by the permanent deformation of the fixing film in the comparative example and the first embodiment.

FIG. 15 is a diagram describing an effect for a recess portion formed by the permanent deformation of the fixing film when the image forming apparatus is operated in an environment of 0° C. in the comparative example and the second embodiment.

DESCRIPTION OF THE EMBODIMENTS

Embodiments of an image forming apparatus according to the invention will be described in detail with reference to the drawings. Additionally, numerical values and configuration conditions shown in the following embodiments are reference numerical values and reference configurations and do not limit the invention.

First Embodiment

A configuration of a first embodiment of an image forming apparatus according to the invention will be described with reference to FIGS. 1 to 11.

Image Forming Apparatus

Figure 1:
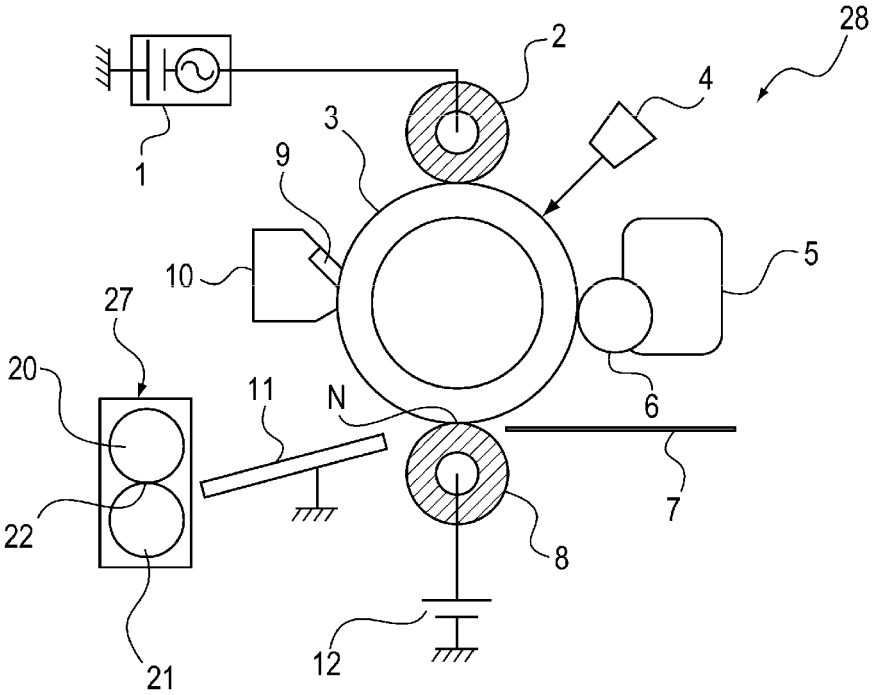
FIG. 1 is a cross-sectional explanatory diagram illustrating a configuration of an image forming apparatus according to the invention.

A configuration of the image forming apparatus according to the invention will be described with reference to FIG. 1. FIG. 1 is a cross-sectional explanatory diagram illustrating a configuration of the image forming apparatus according to the invention. In an image forming apparatus 28 illustrated in FIG. 1, as an image forming flow, a charging bias is first applied from a charging bias power supply 1 to a charging roller 2, which is a charging portion rotating in a following manner while contacting a surface of a photosensitive drum 3, which is an image bearing member rotating in a clockwise direction of FIG. 1. Accordingly, the surface of the photosensitive drum 3 is charged to a predetermined uniform potential.

A surface potential of the photosensitive drum 3 is decreased to a predetermined potential by exposing an image forming point on the uniformly charged surface of the photosensitive drum 3 to light corresponding to the image information using an exposing device 4, which is an exposing portion.

Toner 17 (developer), which is accommodated in a developing container of a developing device 5, which is a developing portion, is uniformly formed on a surface of a developing sleeve 6, which is a developer bearing member. By using an action of an electrical field generated by a difference between the potential on the surface of the photosensitive drum 3 decreased by the exposure and the potential applied to the developing sleeve 6, the toner 17 on the surface of the developing sleeve 6, which is charged in advance, is made to fly and adhere onto the surface of the photosensitive drum 3.

Meanwhile, a recording material 16, which is a recording medium, such as a sheet fed by a feeding portion (not illustrated), is conveyed along a pre-transfer guide 7 to a transfer nip portion N formed by the surface of the photosensitive drum 3 and a transfer roller 8, which is a transfer portion. When a transfer bias is applied from a transfer bias power supply 12 illustrated in FIG. 2 to the transfer roller 8, the toner 17 adhered onto the surface of the photosensitive drum 3 is transferred to the recording material 16. The toner 17 that remains on the surface of the photosensitive drum 3 after the transfer is scraped off by a cleaning blade 9, which is a cleaning portion, and is collected in a collection container 10.

The recording material 16 on which a toner image corresponding to an unfixed image is transferred at the transfer nip portion N is nipped by the photosensitive drum 3 and the transfer roller 8 and is conveyed along an entrance guide 11. Then, the recording material 16 is conveyed to a fixing nip portion 22 formed by a pressure roller 21 corresponding to a pressing and rotating member and a fixing unit 20 of a fixing device 27 corresponding to a fixing portion.

The recording material is heated and pressed while being nipped and conveyed by the pressure roller 21 and an outer peripheral surface of a fixing film 15 corresponding to the heating and rotating member provided in the fixing unit 20, so that the toner image is thermally melted and transferred onto the recording material 16. The fixing device 27 (the fixing portion) heats and fixes the toner image (the unfixed image) formed on the recording material 16 (the recording medium) during the image forming operation, while nipping and conveying the recording material 16 by the rotation of the fixing film 15 and the pressure roller 21 corresponding to a pair of rotating members. Then, the recording material is discharged to the outside of the apparatus by a discharging portion (not illustrated).

Figure 2:
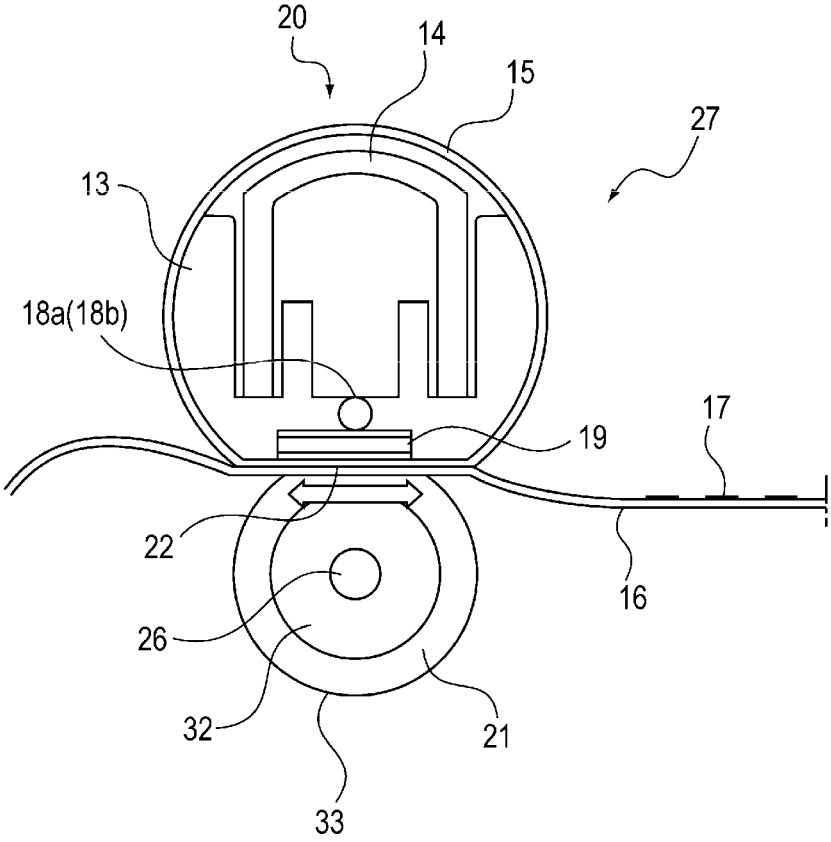
FIG. 2 is a cross-sectional explanatory diagram illustrating a configuration of a fixing device.

Next, a configuration of the fixing device 27 will be described with reference to FIG. 2. FIG. 2 is a cross-sectional explanatory diagram illustrating a configuration of the fixing device 27. The fixing device 27 illustrated in FIG. 2 includes the fixing unit 20 and the pressure roller 21 corresponding to a pressing portion. The fixing unit 20 includes a heater 19, which is a heating portion, the fixing film 15, a film guide 13, a stay 14, and thermistors 18*a* and 18*b* configured as temperature detection elements. The thermistors 18*a* and 18*b* (the detection portion) detect the temperature of the fixing film 15 (the rotating member).

Figure 3:
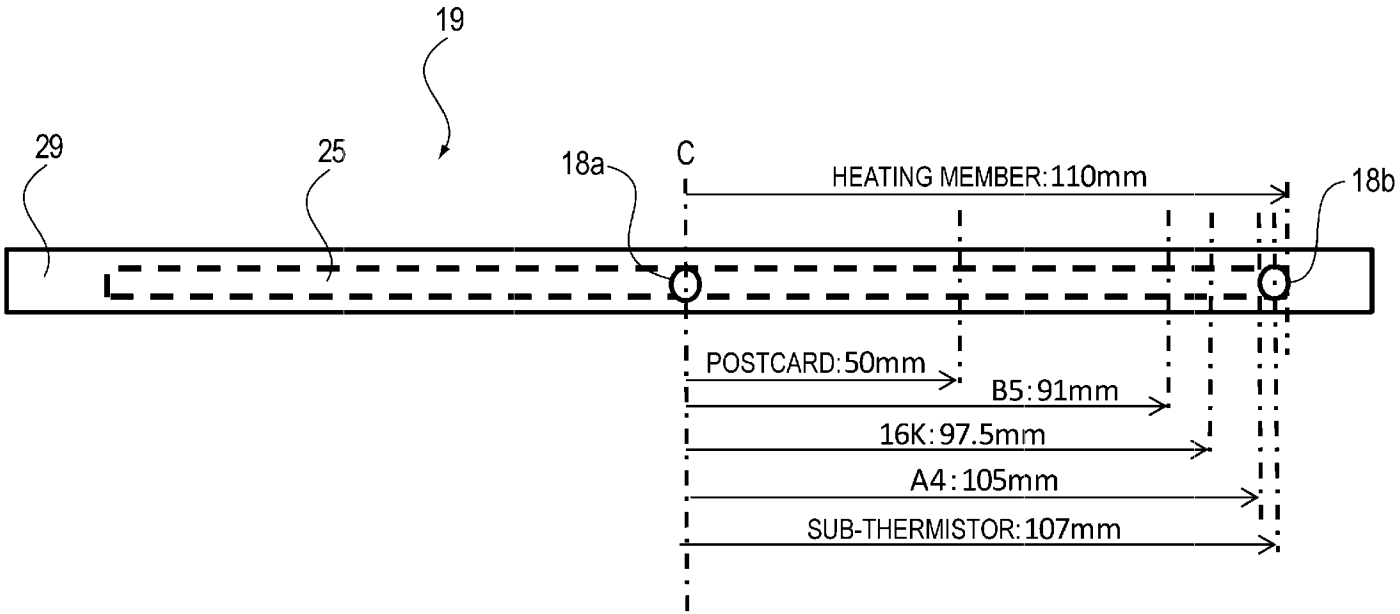
FIG. 3 is a plan explanatory diagram illustrating a positional relationship between a width-direction end portion of a recording material and a thermistor in a longitudinal direction of a heater.

The heater 19 includes a heating member 25 in which a heating paste is printed on a ceramic substrate 29 having an electrical insulation property, illustrated in FIG. 3, and a glass coating layer that protects the heating member 25 and ensures an insulation property. An alternating current (AC) power is controlled by a power supply (not illustrated) is supplied to the heating member 25 so that heat is generated.

A base film thickness of the fixing film 15, which is one of a pair of rotating members and has a film-shaped structure, is 100 μm or less. Further, a base material of the fixing film 15 is metal. The fixing film 15 of the embodiment is formed in a cylindrical shape having an outer diameter of 32 mm and formed of stainless steel (SUS) having a thickness of about 70 μm. The fixing film 15 is heated by the heater 19 (the heating portion). The fixing film 15 highly efficiently transfers heat from the heater 19 to the toner 17 on the recording material 16.

The film guide 13 is provided with a plurality of circular-arc ribs provided in the longitudinal direction of the film guide 13 to slide on the inner peripheral surface of the fixing film 15. Accordingly, the rotation of the fixing film 15 is assisted while the sliding resistance with respect to the inner peripheral surface of the fixing film 15 is suppressed. The stay 14 is formed of a steel plate and uniformly applies a pressure in the longitudinal direction of the film guide 13.

The thermistors 18*a* and 18*b* provided at the rear side of the substrate 29 detect a change in temperature of the heater 19. Based on the detection results detected by the thermistors 18*a* and 18*b*, a target temperature of the heater 19 is determined. A heater driving portion 30 is controlled by a central processing unit (CPU) 31, which is a controller, illustrated in FIG. 4, so that AC power supplied to the heater 19 is controlled. Accordingly, a temperature of the heater 19 is maintained at a target temperature (a printing temperature).

The CPU 31 determines a temperature of the fixing film 15 inside the fixing nip portion 22 based on the detection results of the thermistors 18*a* and 18*b* provided at the rear side of the ceramic substrate 29. The CPU 31 also serves as a detection portion that detects a temperature of the fixing film 15. The CPU 31 (the detection portion) predicts the temperature of the fixing film 15 from the temperature detection result of the heater 19 (the heating portion) obtained by the thermistors 18*a* and 18*b* corresponding to the detection portions.

In the pressure roller 21, an elastic layer 32, formed of conductive silicone rubber having a low volume efficiency of about 1×105 Ω·cm, is coated on an outer periphery of a metal core 26 formed of aluminum to have an outer diameter of 12 mm. A surface layer 33, which is coated with an insulation tube of about 60 μm, is provided on the outer periphery of the elastic layer 32. The outer diameter of the pressure roller 21 is 20 mm.

The pressure roller 21 is pressed against the heater 19 at a predetermined pressure (fixing nip pressure) via the fixing film 15 by an urging portion, such as a spring (not illustrated). The fixing nip portion 22 of 5 mm to 8 mm is formed in the recording material conveying direction (the right-to-left direction in FIG. 2) by the outer peripheral surface of the fixing film 15 and the surface of the pressure roller 21.

The pressure roller 21 is rotationally driven by a motor 34, which is a driving portion. The CPU 31 illustrated in FIG. 4 rotates the pressure roller 21 by controlling the driving of the motor 34 through a motor driver 35. The fixing film 15 rotates to follow the pressure roller 21 by a contact resistance with respect to the surface of the pressure roller 21 or a contact resistance with respect to the recording material 16 nipped at the fixing nip portion 22. Accordingly, the recording material 16, which is conveyed to the fixing nip portion 22, is conveyed while it is adhered to the outer peripheral surface of the fixing film 15.

The recording material 16 is conveyed to the fixing nip portion 22 and is nipped and conveyed by the outer peripheral surface of the fixing film 15 and the surface of the pressure roller 21. Then, the unfixed toner image formed on the recording material 16 is heated and pressed by the heat of the heater 19 and the fixing nip pressure to be fixed.

FIG. 3 is a plan explanatory diagram illustrating a positional relationship between a width-direction end portion orthogonal to the conveying direction of the recording material 16 and the thermistors 18*a* and 18*b* in the longitudinal direction of the heater 19. In the embodiment, the recording material 16 is conveyed in the longitudinal direction of the fixing nip portion 22 with reference to the center. As illustrated in FIG. 3, the heating member 25 having a length of 110 mm is provided on the substrate 29 of the heater 19, and is located at both sides of the width direction based on the width-direction center C orthogonal to the conveying direction of the recording material 16. In order to control the temperature of the heating member 25, the thermistor 18*a* is disposed at the width-direction center C. The thermistor 18*a* detects a temperature of a passage area through which the recording material 16 passes through the fixing nip portion 22.

Meanwhile, the thermistor 18*b* is disposed at a longitudinal end portion of the heating member 25. The thermistor 18*b* detects a temperature of a non-passage area through which the recording material 16 does not pass through the fixing nip portion 22. The temperature of the heater 19 is detected by the thermistors 18*a* and 18*b* and the temperature of the fixing device 27 is controlled.

Controller

Figure 4:
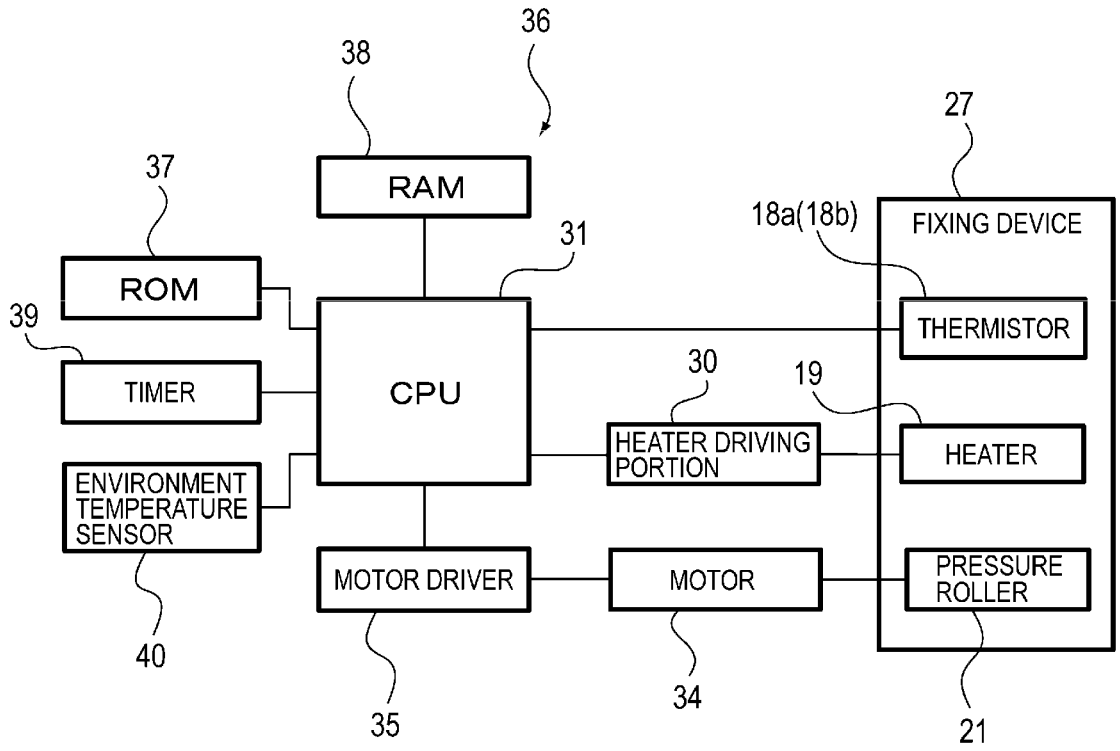
FIG. 4 is a block diagram illustrating a configuration of a control system of the image forming apparatus.

FIG. 4 is a block diagram illustrating a configuration of a control system of the image forming apparatus 28. A controller 36 illustrated in FIG. 4 includes a CPU 31 that executes a process according to a control program. Further, the controller includes a read only memory (ROM) 37, which stores data or program executed by the CPU 31. Furthermore, the controller includes a random access memory (RAM) 38, which is a memory area used as a work area. The RAM 38 (the storage portion) stores history information of the image forming operation.

The CPU 31 controls the power supplied to the heater 19 by controlling the heater driving portion 30 based on the detection results of the thermistors 18*a* and 18*b* corresponding to the detection portions provided at the rear side of the ceramic substrate 29. Accordingly, the CPU 31, which is the controller, maintains the heater 19 at the target temperature. The CPU 31 rotationally drives the pressure roller 21 by driving the motor 34 through the motor driver 35.

Figure 5:
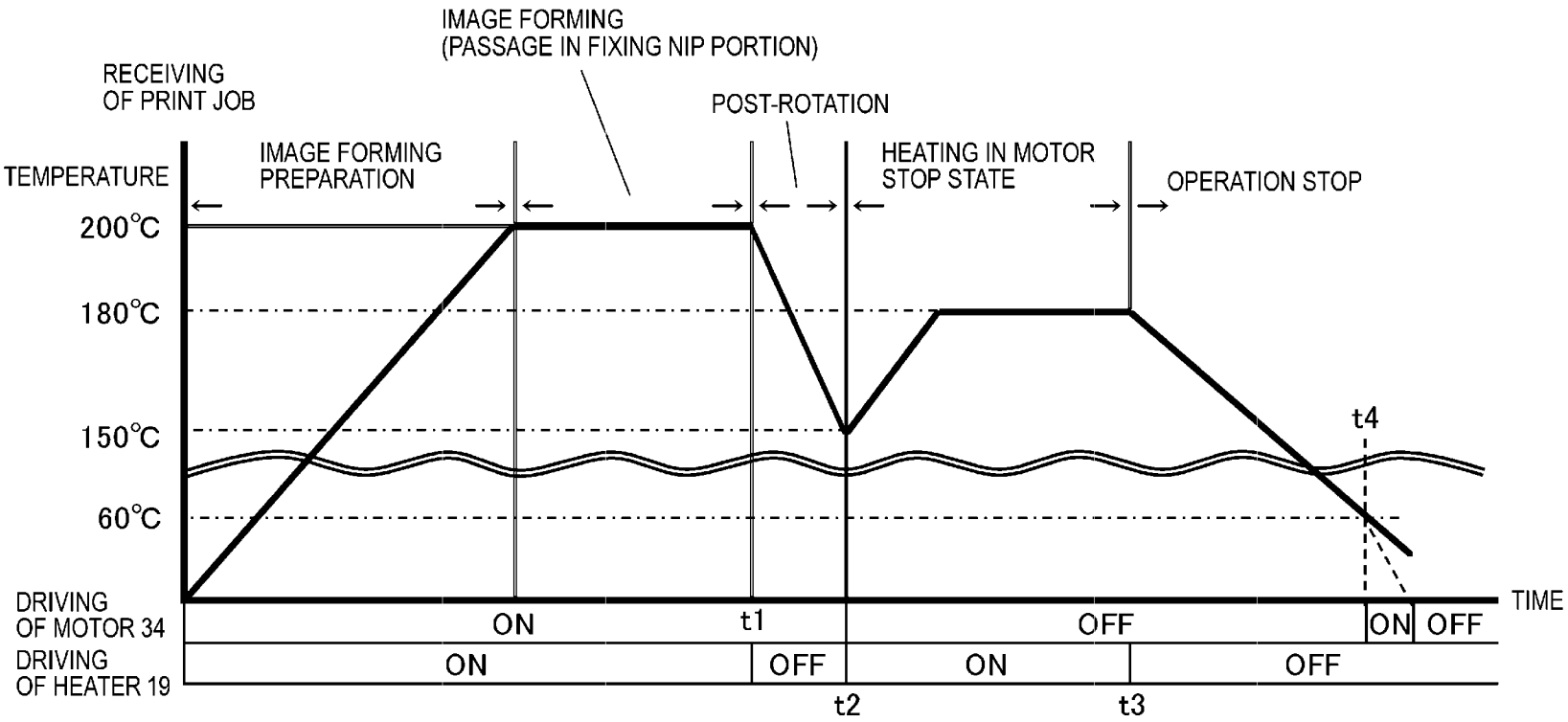
FIG. 5 is a diagram illustrating a driving state and a temperature of a heater and a driving state of a pressure roller during an image forming operation.

FIG. 5 is a diagram illustrating a driving state and a temperature of the heater 19 during the image forming operation and a driving state of the pressure roller 21. As illustrated in FIG. 5, when the image forming apparatus 28 receives a print job, the CPU 31 drives (turns on) the motor 34 through the motor driver 35 illustrated in FIG. 4 and drives (turns on) the heater 19 by controlling the heater driving portion 30.

Then, the CPU 31 prepares an image forming operation until the temperature of the heater 19 reaches about 200° C., which is a temperature necessary for a fixing operation. When the temperature of the heater 19 reaches a predetermined temperature (about 200° C.), the CPU 31 starts the feeding of the recording material 16 by a feeding portion (not illustrated) and transfers the toner image formed on the surface of the photosensitive drum 3 onto the recording material 16 by the transfer roller 8. The recording material 16, which bears the unfixed toner image, passes through the fixing nip portion 22 so that the toner image is fixed to the recording material 16. After the image forming operation ends, the CPU 31 turns off the driving of the heater 19 and drives the motor 34 at the time t1 in order to obtain a flat temperature distribution in the longitudinal direction of the fixing nip portion 22. Accordingly, a post-rotation operation is performed corresponding to the cooling operation of the fixing nip portion 22.

When the temperature of the fixing nip portion 22 in the longitudinal direction becomes flat, the CPU 31 stops the driving of the motor 34 and drives the heater 19 again at the time t2. Accordingly, the temperature inside the fixing nip portion 22 is raised to about 180° C. corresponding to a temperature at which the toner 17 adhered to the surface of the pressure roller 21 is melted. Then, the CPU 31 maintains a state in which the temperature inside the fixing nip portion 22 is about 180° C. for a predetermined time. Then, the driving of the heater 19 is turned off at the time t3.

When a predetermined time elapses after the CPU 31 turns off the driving of the heater 19 at the time t3, the temperature of the toner 17 adhered to the outer peripheral surface of the fixing film 15 decreases to about 60° C. corresponding to a temperature at which the toner image is fixed to the outer peripheral surface of the fixing film 15. In that state, the CPU 31 drives the motor 34 so that the pressure roller 21 rotates by the width of the fixing nip portion 22 in the recording material conveying direction at the time t4. Accordingly, the toner 17 adhered to the surface of the pressure roller 21 is moved toward the outer peripheral surface of the fixing film 15 so as to clean the surface of the pressure roller 21. This cleaning operation is performed by using a difference between the heat capacity of the pressure roller 21 and the heat capacity of the fixing film 15.

That is, the CPU 31 (the controller) performs a stop state heating operation on the fixing device 27 (the fixing portion) while the fixing film 15 and the pressure roller 21 corresponding to a pair of rotating members are stopped at a timing (the time t2 to t3 on the horizontal axis of FIG. 5) different from the image forming operation and performs a heating operation on the fixing device 27 (the fixing portion) while rotating the fixing film 15 and the pressure roller 21 before the stop state heating operation is performed (before the time t1 on the horizontal axis of FIG. 5). At this time, the CPU 31 (the controller) rotates and heats the fixing film 15 and the pressure roller 21 at the same time during the heating operation performed while rotating the fixing film 15 and the pressure roller 21 before the stop state heating operation.

Figure 6:
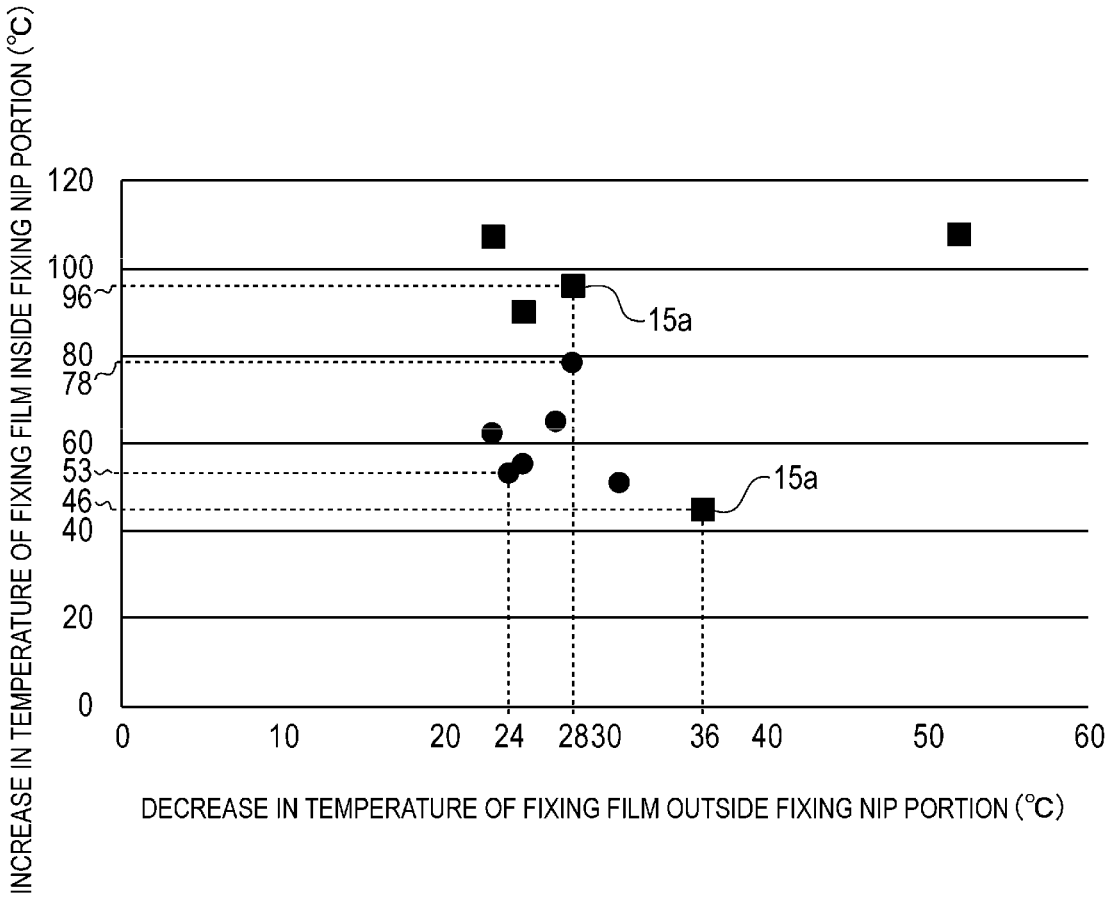
FIG. 6 is a diagram illustrating a relationship of a recess portion formed by the permanent deformation of a fixing film with respect to an increase in temperature of the fixing film inside a fixing nip portion and a decrease in temperature of the fixing film outside the fixing nip portion at the time of heating the heater during the stop of the pressure roller.
Figure 20A:
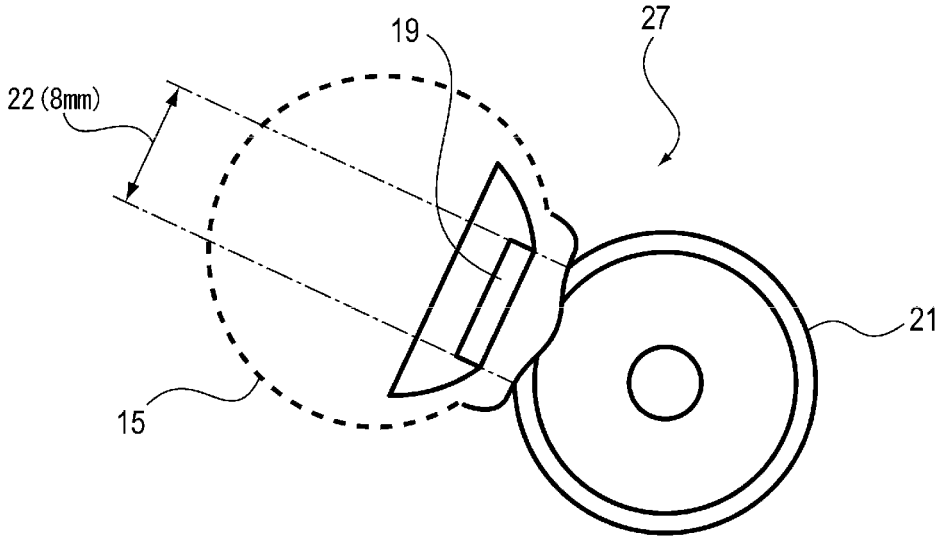
FIGS. 20A and 20B are cross-sectional explanatory diagrams illustrating a state in which a recess portion is formed by the permanent deformation of a fixing film.
Figure 20B:
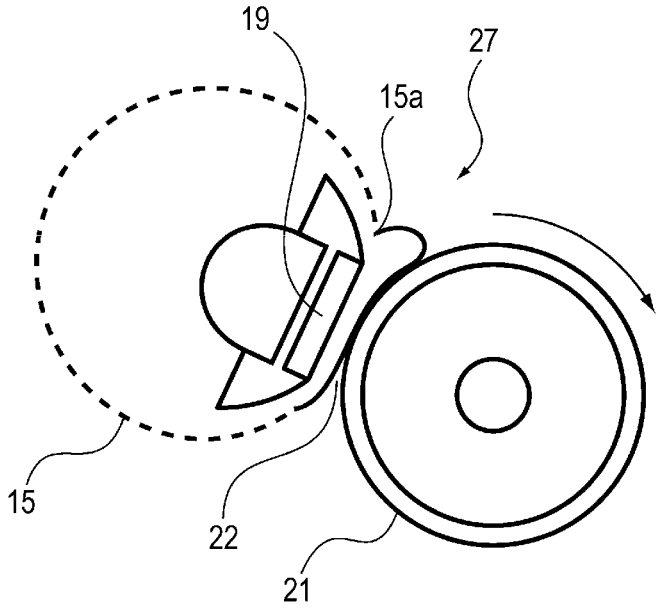

FIG. 6 is a diagram illustrating a relationship of a recess portion 15*a* formed by the permanent deformation of the fixing film 15 with respect to an increase in temperature of the fixing film 15 inside the fixing nip portion 22 and a decrease in temperature of the fixing film 15 outside the fixing nip portion 22 at the time of heating the heater 19 during the stop of the pressure roller 21. As illustrated in FIG. 6, when the pressure roller 21 is stopped, the heater 19 is heated so that the temperature of the fixing film 15 inside the fixing nip portion 22 is increased by about 96° C. and the temperature of the fixing film 15 outside the fixing nip portion 22 is decreased by about 28° C. In that state, the motor 34 is driven so that the pressure roller 21 is rotated and the fixing film 15 is rotated in a following manner. Then, as illustrated in FIG. 20B, the recess portion 15*a* is formed by the permanent deformation of the fixing film 15 "■ of FIG. 6".

In contrast, in a state in which an increase in temperature of the fixing film 15 inside the fixing nip portion 22 is suppressed to about 78° C. and the temperature of the fixing film 15 outside the fixing nip portion 22 is decreased by about 28° C., the motor 34 is driven so that the pressure roller 21 is rotated and the fixing film 15 is rotated in a following manner. Then, the recess portion 15*a* is not formed by the permanent deformation of the fixing film 15 "● of FIG. 6".

In a state in which an increase in temperature of the fixing film 15 inside the fixing nip portion 22 is suppressed to about 46° C. and the temperature of the fixing film 15 outside the fixing nip portion 22 is largely decreased by about 36° C., the motor 34 is driven so that the pressure roller 21 is rotated and the fixing film 15 is rotated in a following manner. Then, the recess portion 15*a* is formed by the permanent deformation of the fixing film 15 "■ of FIG. 6".

In a state in which the fixing film 15 is warmed, the heater 19 is heated when the pressure roller 21 is stopped. An increase in temperature of the fixing film 15 inside the fixing nip portion 22 is suppressed to about 53° C. and a decrease in temperature of the fixing film 15 outside the fixing nip portion 22 is suppressed to about 24° C. so that a difference between temperatures inside and outside the fixing nip portion 22 becomes small. Then, the recess portion 15*a* is not formed by the permanent deformation of the fixing film 15 "● of FIG. 6".

Further, although not illustrated in the drawings, it is proven that a local distortion is generated in the fixing film 15 inside the fixing nip portion 22 when a temperature difference is generated in the fixing film 15 inside and outside the fixing nip portion 22. When a temperature unevenness is generated in the circumferential direction of the fixing film 15, stress is generated by the expansion unevenness in the circumferential direction of the fixing film 15. Then, as illustrated in FIG. 20A, a local distortion is generated in the fixing film 15. When the image forming operation starts in this state so that the pressure roller 21 is driven, the distorted fixing film 15 which is not locally maintained in a circular shape is pulled in the rotation direction to follow the pressure roller 21, as illustrated in FIG. 20B.

For this reason, it is considered that the recess portion 15*a* is formed by the permanent deformation of the fixing film 15 as illustrated in FIG. 20B since pulling stress in the rotation direction due to the rotational driving of the pressure roller 21 is applied to the locally distorted fixing film 15. From this test, it is proved that the permanently deformed recess portion 15*a* is not formed when the pressure roller 21 is not rotationally driven even when the fixing film 15 is distorted. From this result, in order to prevent the formation of the recess portion 15*a* by the permanent deformation of the fixing film 15, it is desirable to reduce a temperature unevenness in the circumferential direction of the fixing film 15 at the time of heating the heater 19 during the stop of the pressure roller 21. With such a configuration, since the local distortion of the fixing film 15 is not generated, the permanent deformation of the fixing film 15 can be prevented.

Figure 7:
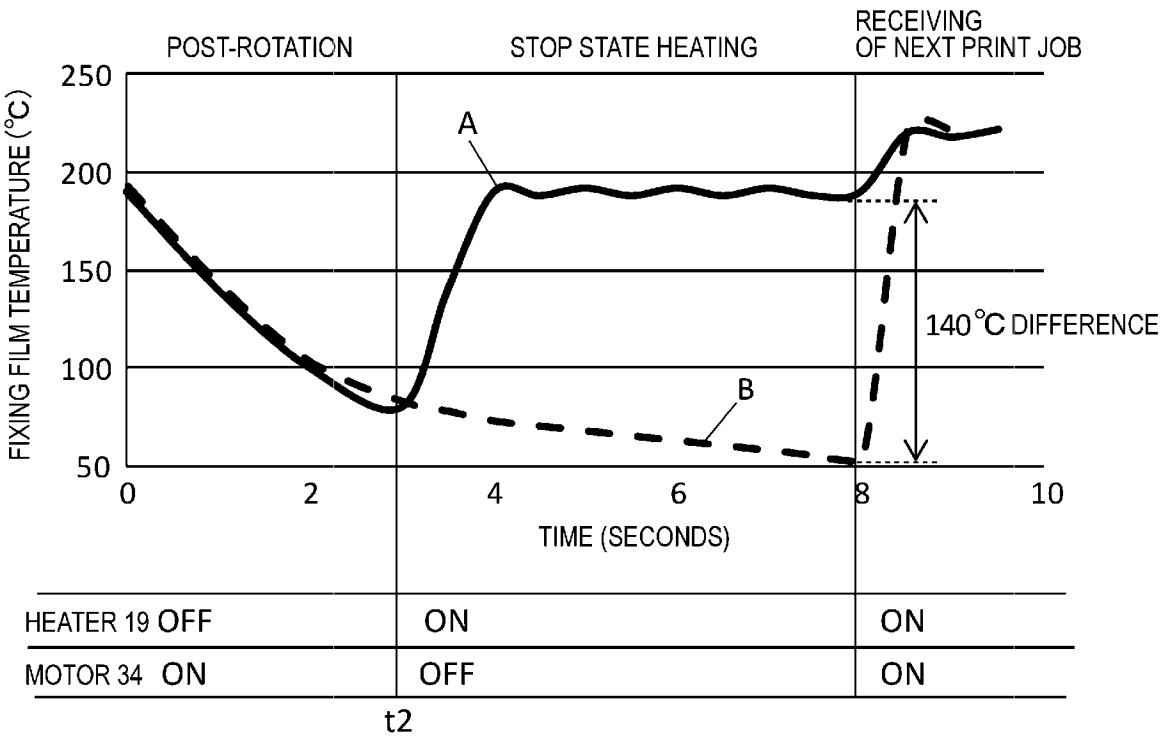
FIG. 7 is a diagram illustrating a transition of a temperature of a fixing film outside a fixing nip portion and a temperature of the fixing film inside the fixing nip portion when driving of a pressure roller is stopped and the heater is heated after a post-rotation of decreasing the temperature of the fixing film after an image forming operation ends in an image forming apparatus of a comparative example.

As the comparative example, a case in which the driving of the rotating pressure roller 21 is stopped after the temperature of the fixing film 15 decreases after the image forming operation in the image forming apparatus 28 will be described. FIG. 7 is a diagram illustrating a transition of the temperature of the fixing film 15 inside the fixing nip portion 22 and the temperature of the fixing film 15 outside the fixing nip portion 22 at the time of heating the heater 19 in that state. A graph A of FIG. 7 indicates the temperature of the fixing film 15 inside the fixing nip portion 22. A graph B indicates the temperature of the fixing film 15 outside the fixing nip portion 22.

After the image forming operation ends, the fixing nip portion 22 is cooled until a temperature distribution in the longitudinal direction becomes flat. For this cooling operation, the CPU 31 drives the motor 34 to rotate the pressure roller 21 and to rotate the fixing film 15 in a following manner while turning off the heater 19. Then, the temperature of the fixing film 15 inside the fixing nip portion 22 indicated by the graph A and the temperature of the fixing film 15 outside the fixing nip portion 22 indicated by the graph B in FIG. 7 decrease by substantially the same temperature and the entire temperature of the fixing film 15 uniformly decreases.

After the post-rotation operation of cooling the fixing device 27 ends, the CPU 31 turns on the heater 19 to be heated again while stopping the driving of the motor 34 at the time t2. Then, the temperature of the fixing film 15 outside the fixing nip portion 22 indicated by the graph B decreases as the temperature of the fixing film 15 inside the fixing nip portion 22 indicated by the graph A in FIG. 7 increases. For that reason, the temperature of the fixing film 15 is set so that a temperature difference between temperatures of the inside of the fixing nip portion 22 and the outside of the fixing nip portion 22 becomes about 140° C.

For this reason, only the fixing film 15 inside the fixing nip portion 22 formed by the fixing film 15 and the pressure roller 21 is thermally expanded and the fixing film 15 outside the fixing nip portion 22 is not thermally expanded. For this reason, an expansion unevenness is generated in the circumferential direction of the fixing film 15 by a thermal expansion portion and a non-thermal expansion portion in the circumferential direction of the fixing film 15. Since the expansion unevenness is generated in the circumferential direction of the fixing film 15, thermal stress is applied to the fixing film 15 so that a local distortion is generated in the fixing film 15.

When the CPU 31 starts the image forming operation so that the pressure roller 21 is driven in this state, the distorted fixing film 15, which is not locally maintained in a circular shape, is pulled in the rotation direction to follow the pressure roller 21. Since pulling stress in the rotation direction following the pressure roller 21 is applied to the locally distorted fixing film 15, the recess portion 15*a* is formed by the permanent deformation of the fixing film 15.

Figure 8:
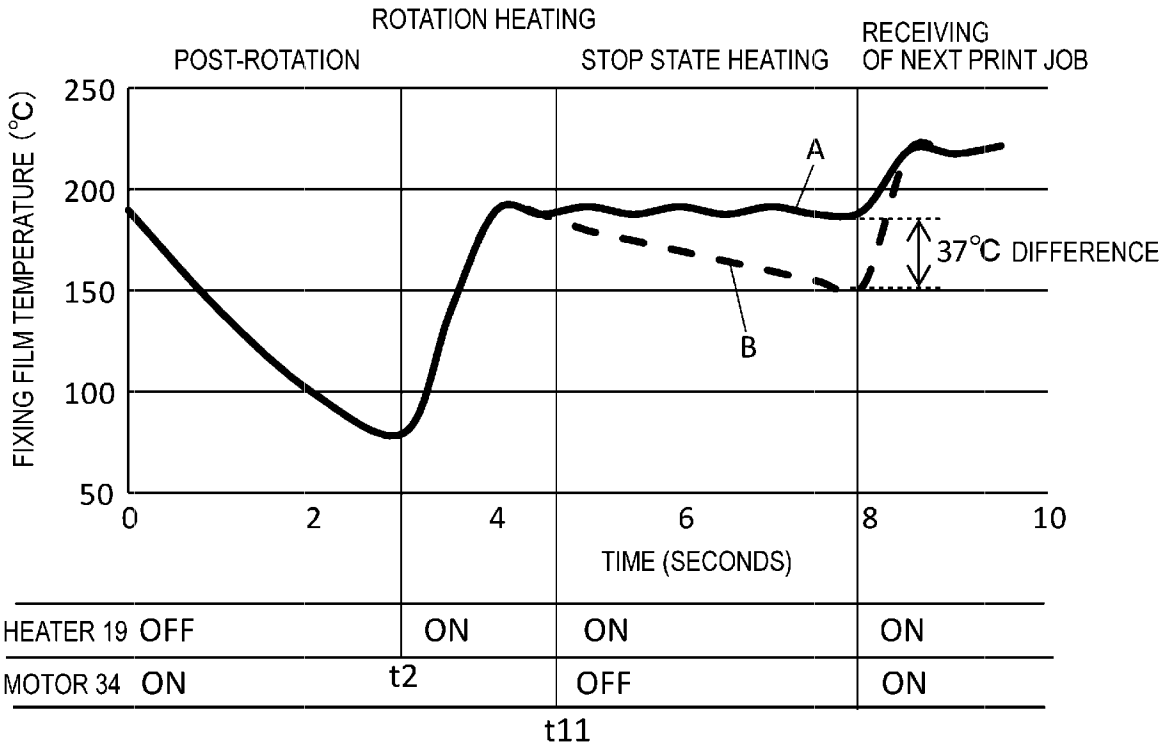
FIG. 8 is a diagram illustrating a transition of a temperature of a fixing film outside a fixing nip portion and a temperature of the fixing film inside the fixing nip portion when a heater is heated in a state in which rotational driving of a pressure roller continues for a predetermined time after a post-rotation of decreasing the temperature of the fixing film in an image forming apparatus of a first embodiment.

In the image forming apparatus 28 of the embodiment, the CPU 31 continues the rotational driving of the pressure roller 21 for a predetermined time after the post-rotation of decreasing the temperature of the fixing film 15. FIG. 8 is a diagram illustrating a transition of the temperature of the fixing film 15 inside the fixing nip portion 22 and the temperature of the fixing film 15 outside the fixing nip portion 22 at the time of heating the heater 19 in that state. A graph A of FIG. 8 indicates the temperature of the fixing film 15 inside the fixing nip portion 22. A graph B indicates the temperature of the fixing film 15 outside the fixing nip portion 22.

The CPU 31 performs the post-rotation in order to cool the fixing nip portion 22 until the temperature distribution becomes flat in the longitudinal direction of the fixing nip portion 22 after the end of the image forming operation. Then, the temperature of the fixing film 15 inside the fixing nip portion 22 indicated by the graph A and the temperature of the fixing film 15 outside the fixing nip portion 22 indicated by the graph B in FIG. 8 decrease by substantially the same temperature and the entire temperature of the fixing film 15 uniformly decreases.

The CPU 31 turns on the heater 19 to be heated at the time t2 again. In the embodiment, as illustrated in FIG. 8, the driving of the motor 34 continues to rotate the pressure roller 21 and is controlled so that the temperature of the fixing film 15 inside the fixing nip portion 22 reaches a predetermined temperature.

At this time, the CPU 31 (the controller) performs control in which the rotation of the fixing film 15 and the pressure roller 21 starts ahead of the heating operation in the heating operation performed while rotating the fixing film 15 and the pressure roller 21 before the stop state heating operation. Further, although not illustrated in the drawings, the same effect can be obtained when the driving of the motor 34 is performed before or simultaneously when the heater 19 is turned on even when the motor 34 is instantly stopped in order to switch the control at the time t2 on the horizontal axis of FIG. 8.

Accordingly, when the CPU 31 heats the heater 19 again, a temperature difference of the fixing film 15 inside and outside the fixing nip portion 22 is not generated. The CPU 31 stops the driving of the motor 34 at the time t1 after the temperature of the fixing film 15 reaches a predetermined temperature. Accordingly, the temperature of the fixing film 15 inside the fixing nip portion 22 indicated by the graph A of FIG. 8 is maintained at a predetermined temperature. The temperature of the fixing film 15 outside the fixing nip portion 22 indicated by the graph B decreases.

Accordingly, a temperature difference of the fixing film 15 inside and outside the fixing nip portion 22 starts to be generated. In the embodiment, since the CPU 31 turns on the heater 19 to be heated while the motor 34 is turned on to be driven so that the pressure roller 21 rotates, however, the fixing film 15 is warmed to one temperature. Accordingly, a temperature difference of the fixing film 15 inside and outside the fixing nip portion 22 can be decreased to 37° C. Accordingly, stress caused by the expansion unevenness in the circumferential direction of the fixing film 15 is suppressed, and the local distortion is not generated in the fixing film 15. Accordingly, the formation of the recess portion 15*a* by the permanent deformation of the fixing film 15 can be prevented even when the pressure roller 21 is driven by starting the next image forming operation.

Operation of Comparative Example

Figure 9:
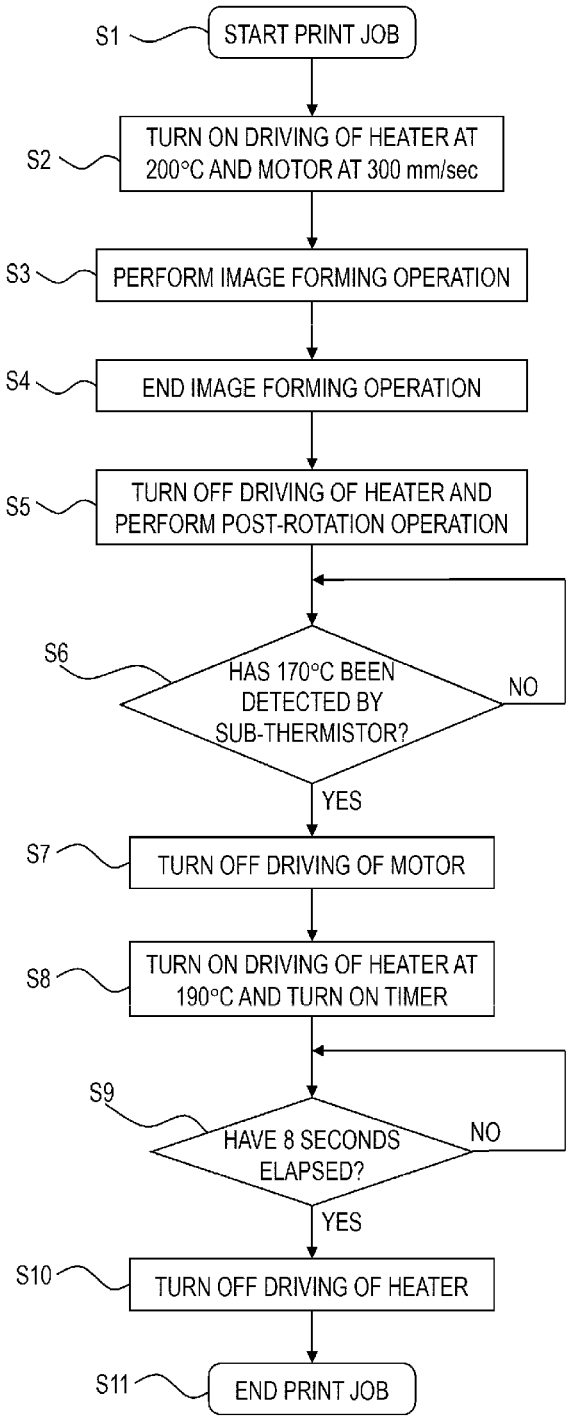
FIG. 9 is a flowchart illustrating an operation of the image forming apparatus of the comparative example.

FIG. 9 is a flowchart illustrating an operation of the image forming apparatus 28 of the comparative example. When a print job starts in Step S1 of FIG. 9, the CPU 31 turns on the heater 19 and controls the temperature at 200° C. in Step S2. Further, the CPU 31 turns on the driving of the motor 34 and rotates the pressure roller 21 at a circumferential velocity of 300 mm/sec. Then, the image forming operation starts in Step S3.

Next, in Step S4, the routine proceeds to Step S5 after the end of the image forming operation and the CPU 31 turns off the driving of the heater 19 and performs the post-rotation operation of continuing the driving of the motor 34. Next, in Step S6, the CPU 31 determines whether the temperature detected by the thermistor 18*b* (the sub-thermistor) provided to correspond to one end portion of the heating member 25 in the longitudinal direction illustrated in FIG. 3 becomes 170° C. or less. In Step S6, the driving of the motor 34 is maintained in the ON state until the temperature detected by the thermistor 18*b* becomes 170° C. or less. Then, when the temperature detected by the thermistor 18*b* becomes 170° C. or less, the routine proceeds to Step S7 and the CPU 31 turns off the driving of the motor 34.

Next, the routine proceeds to Step S8 and the CPU 31 turns on the heater 19 and controls the temperature at 190° C. At that time, the CPU 31 turns on the timer 39. In Step S9, the CPU 31 determines whether 8 seconds have elapsed after turning on the timer 39. In Step S9, the CPU 31 continues the driving of the heater 19 until 8 seconds have elapsed after turning on the timer 39. In Step S9, when 8 seconds have elapsed after turning on the timer 39, the routine proceeds to Step S10 and the CPU 31 turns off the driving of the heater 19. Next, the routine proceeds to Step S11 and the print job ends.

Operation of First Embodiment

Figure 10:
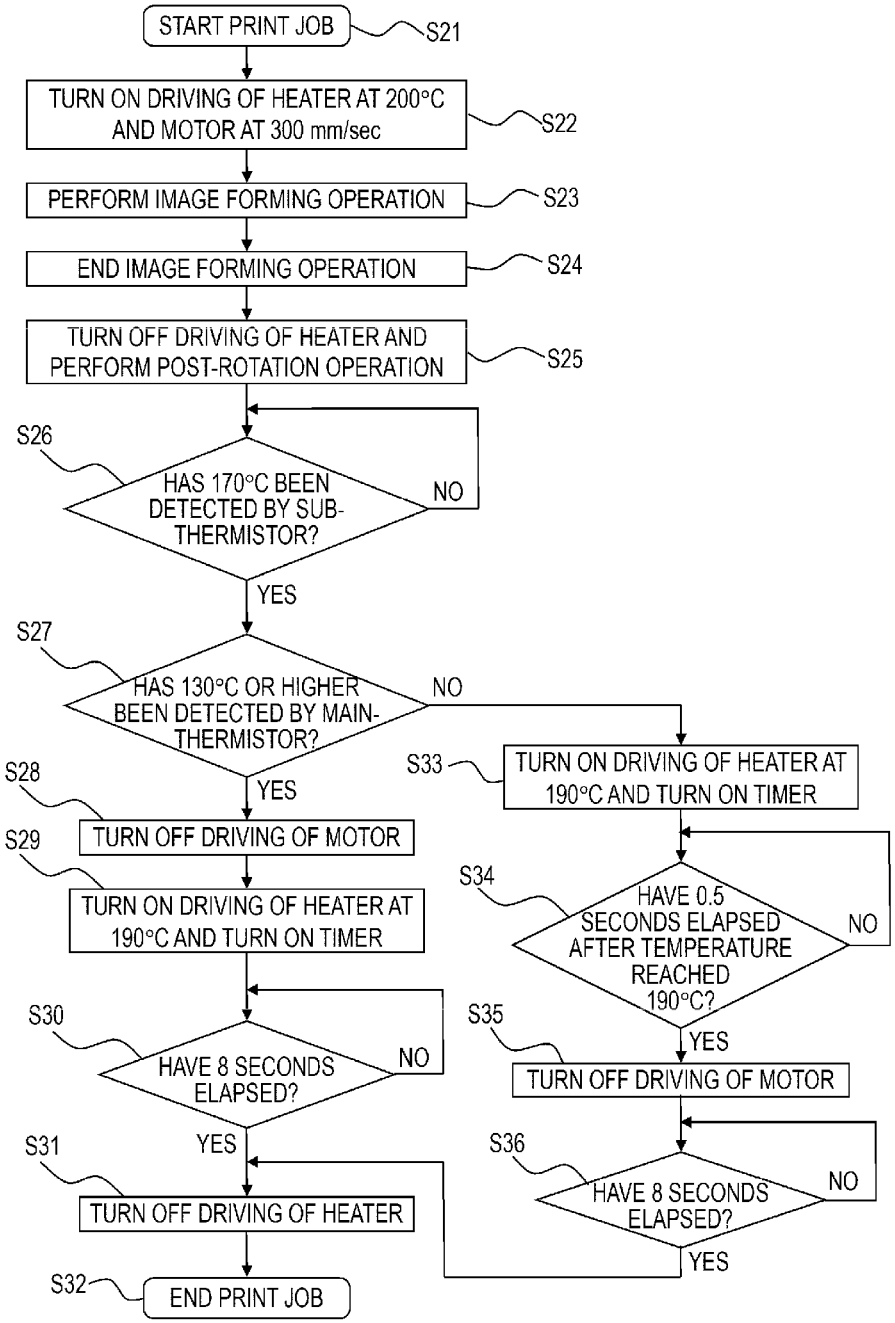
FIG. 10 is a flowchart illustrating an operation of the image forming apparatus of the first embodiment.

FIG. 10 is a flowchart illustrating an operation of the image forming apparatus 28 of the embodiment. In the embodiment, the temperature of the fixing film 15 inside the fixing nip portion 22 is substantially the same as the temperature of the heater 19. For this reason, the temperature of the fixing film 15 inside the fixing nip portion 22 is controlled while being predicted from the detection result of the thermistor 18*a* (the main thermistor) disposed at the center of the longitudinal direction of the heating member 25 of FIG. 3 detecting the temperature of the heater 19.

In Step S21 of FIG. 10, the image forming apparatus 28 starts the print job. Next, the routine proceeds to Step S22 and the CPU 31 turns on the heater 19 and controls the temperature at 200° C. Further, the CPU 31 turns on the driving of the motor 34 and rotates the pressure roller 21 at the circumferential velocity of 300 mm/sec.

Next, in Step S23, the image forming operation starts. Next, in Step S24, the image forming operation ends. Next, in Step S25, the CPU 31 turns off the driving of the heater 19 and performs the post-rotation operation of continuing the driving of the motor 34. Next, in Step S26, the CPU 31 determines whether the temperature detected by the thermistor 18*b* (the sub-thermistor) provided to correspond to one end portion of the heating member 25 in the longitudinal direction illustrated in FIG. 3 becomes 170° C. or less. In Step S26, the driving of the motor 34 is maintained in the ON state until the temperature detected by the thermistor 18*b* becomes 170° C. or less.

In Step S26, when the temperature detected by the thermistor 18*b* becomes 170° C. or less, the routine proceeds to Step S27 and the CPU 31 checks a detection temperature of the thermistor 18*a* (the main thermistor) disposed at the center in the longitudinal direction of the heating member 25 of FIG. 3. In Step S27, the CPU 31 determines whether the temperature detected by the thermistor 18*a* is 130° C. or greater. In Step S27, when the temperature detected by the thermistor 18*a* is 130° C. or greater, the routine proceeds to Step S28 and the CPU 31 turns off the driving of the motor 34.

Next, the routine proceeds to Step S29 and the CPU 31 turns on the heater 19 and controls the temperature at 190° C. At this time, the CPU 31 also turns on the timer 39. Next, in Step S30, the CPU 31 determines whether 8 seconds have elapsed after turning on the timer 39. In Step S30, the CPU 31 continues the driving of the heater 19 until 8 seconds have elapsed after turning on the timer 39. In Step S30, when 8 seconds have elapsed after turning on the timer 39, the routine proceeds to Step S31 and the CPU 31 turns off the driving of the heater 19. Next, the routine proceeds to Step S32 and the print job ends.

In Step S27, when the temperature detected by the thermistor 18*a* (the main thermistor) is less than 130° C., the routine proceeds to Step S33 and the CPU 31 turns on the heater 19 and controls the temperature at 190° C. Further, the CPU 31 also turns on the timer 39. Next, the routine proceeds to Step S34 and the CPU 31 determines whether 0.5 seconds have elapsed after the temperature detected by the thermistor 18*a* (the main thermistor) reaches 190° C. In Step S34, the CPU 31 continues the driving of the heater 19 and the motor 34 until 0.5 seconds have elapsed after the temperature detected by the thermistor 18*a* (the main thermistor) reaches 190° C.

At this time, in the heating operation performed while rotating the fixing film 15 and the pressure roller 21 during the post-rotation performed after the end of the image forming operation before the stop state heating operation, the rotation time of the fixing film 15 and the pressure roller 21 corresponds to a time in which the fixing film 15 (the rotating member) rotates once or more. The CPU 31 (the controller) increases the temperature of the fixing film 15 outside the fixing nip portion 22 (outside the fixing nip portion) while rotating and heating the fixing film 15 by the heater 19 (the heating portion) during the post-rotation performed after the end of the image forming operation.

In Step S34, when 0.5 seconds have elapsed after the temperature detected by the thermistor 18*a* (the main thermistor) reaches 190° C., the routine proceeds to Step S35 and the CPU 31 continues the driving of the heater 19 and turns off the driving of the motor 34. Next, the routine proceeds to Step S36 and the CPU 31 determines whether 8 seconds have elapsed after turning on the timer 39. In Step S36, when 8 seconds have elapsed after turning on the timer 39, the routine proceeds to Step S31 and the CPU 31 turns off the driving of the heater 19. Next, the routine proceeds to Step S32 and the print job ends.

That is, the CPU 31 (the controller) determines the state of the temperature of the fixing film 15 detected by the CPU 31 (the detection portion) during the post-rotation performed after the end of the image forming operation in Step S26 and Step S27. Then, the heating rotation time and the heating rotation temperature of the fixing film 15 after the end of the post-rotation operation shown in Step S35 are determined in response to the state of the temperature of the fixing film 15 during the post-rotation in Steps S26 and S27.

Then, the fixing film 15 is rotated before or at the same time when the fixing film 15 is heated. Then, it is controlled such that the heating stop of the fixing film 15 shown in Step S31 is later than the rotation stop of the fixing film 15 shown in Step S35 (so that 8 seconds elapse).

That is, the CPU 31 (the controller) changes the rotation time and the heating temperature of each of the fixing film 15 and the pressure roller 21 in response to the temperature of the fixing film 15 immediately before the heating operation while rotating the fixing film 15 and the pressure roller 21. Further, the CPU 31 (the controller) extends the heating rotation time of each of the fixing film 15 and the pressure roller 21 before the stop state heating operation as the temperature of the fixing film 15 decreases.

Further, in Step S27, the CPU 31 determines whether to perform the heating rotation in Step S33 based on the temperature detected by the thermistor 18*a* (the main thermistor). In addition, it may be determined whether to perform the heating rotation performed in Step S33 based on the temperature change during the post-rotation in Step S25 as well as the temperature detected by the thermistor 18*a* (the main thermistor).

Effects of Recess Portion 15*a* of Comparative Example and Embodiments

FIG. 11 is a diagram describing an effect for the recess portion 15*a* formed by the permanent deformation of the fixing film 15 of the comparative example and the embodiment. In the control of the comparative example illustrated in FIG. 9, in Step S4, the image forming operation ends. Then, the routine proceeds to Step S5 and the driving of the motor 34 is stopped in Step S7 after the post-rotation operation. In that state, in Step S8, the heater 19 is turned on and the temperature is controlled at 190° C. For this reason, the temperature of the fixing film 15 inside the fixing nip portion 22 reaches 190° C., but the temperature of the fixing film 15 outside the fixing nip portion 22 continuously decreases to about 50° C.

For that reason, a temperature difference between temperatures inside and outside the fixing nip portion 22 becomes about 140° C. (=190° C.-about 50° C.). For this reason, the recess portion 15*a* is formed by the permanent deformation of the fixing film 15 when the rotational driving of the pressure roller 21 is started after receiving the next print job in a state in which the fixing film 15 is distorted.

In the embodiment of FIG. 10, the routine proceeds to Step S25 after the end of the image forming operation in Step S24. Then, the driving of the motor 34 continues to rotate the pressure roller 21 after the post-rotation operation. In that state, in Step S33, the heater 19 is turned on and the temperature is controlled at 190° C.

Accordingly, the fixing film 15, which rotates to follow the rotation of the pressure roller 21, is uniformly warmed by the heater 19 in the circumferential direction. Next, in Step S35, the heater 19 is heated while the driving of the motor 34 is stopped. Accordingly, the temperature of the fixing film 15 inside the fixing nip portion 22 reaches 190° C., but the temperature of the fixing film 15 outside the fixing nip portion 22 is once warmed to 190° C. and then decreases to about 153° C.

For that reason, a temperature difference between temperatures inside and outside the fixing nip portion 22 can be suppressed to about 37° C. (=190° C.-about 153° C.). For this reason, even when the rotational driving of the pressure roller 21 starts after receiving the next print job in a state in which the distortion of the fixing film 15 is prevented, the formation of the recess portion 15*a* by the permanent deformation of the fixing film 15 can be prevented. Additionally, the temperature of the fixing film 15 outside the fixing nip portion 22 may be monitored by a non-contact thermometer (not illustrated) and also may be predicted from the detection temperature of the thermistors 18*a* and 18*b* during the post-rotation, the print job history, or the environment temperature of the image forming apparatus 28.

In the embodiment, the heater 19 is turned on and the temperature is controlled at a predetermined temperature in a state in which the pressure roller 21 rotates after the post-rotation operation after the end of the image forming operation. Accordingly, the fixing film 15, which rotates to follow the rotation of the pressure roller 21, is uniformly warmed by the heater 19 in the circumferential direction. Next, the heater 19 is heated while the pressure roller 21 is stopped. Accordingly, a temperature difference of the fixing film 15 inside and outside the fixing nip portion 22 decreases.

Accordingly, the toner 17 adhered to the surface of the pressure roller 21 is melted while preventing the distortion of the fixing film 15. Accordingly, the formation of the recess portion 15*a* by the permanent deformation of the fixing film 15 can be prevented when the pressure roller 21 is rotationally driven after receiving the next print job. Further, the toner 17 adhering to the surface of the pressure roller 21 moves to the outer peripheral surface of the fixing film 15, and the surface of the pressure roller 21 can be cleaned.

When the recording material 16 having a short length in a direction orthogonal to the conveying direction compared to the length of the heating member 25 of the heater 19 in the longitudinal direction passes through the fixing nip portion 22, a temperature unevenness is generated in the longitudinal direction of the fixing nip portion 22. For this reason, the fixing nip portion 22 is cooled until the temperature distribution thereof in the longitudinal direction becomes flat after the recording material 16 passes through the fixing nip portion 22. For this reason, the CPU 31 turns off the heater 19, performs the post-rotation of rotating the pressure roller 21, and turns on the heater 19 again. In this case, the motor 34 is driven and the heater 19 is heated while the pressure roller 21 is rotated instead of turning on the heater 19 while stopping the driving of the motor 34 rotating the pressure roller 21.

Accordingly, the fixing film 15 expands in a heated state to be uniform in the circumferential direction of the fixing film 15 and the fixing film 15 is heated in a stop state while a temperature difference of the fixing film 15 inside and outside the fixing nip portion 22 in a heated state decreases. Accordingly, since the expansion unevenness of the fixing film 15 in the circumferential direction due to a temperature difference between temperatures inside and outside the fixing nip portion 22 is reduced, thermal stress generated in the circumferential direction of the fixing film 15 is difficult to be applied to the fixing film 15 and thus, the local distortion of the fixing film 15 is reduced.

For that reason, it is possible to prevent the formation of the recess portion 15*a* by the permanent deformation of the fixing film 15 even when the fixing film 15 is pulled in the rotation direction by the pressure roller 21 after the pressure roller 21 is driven in accordance with the start of the image forming operation. Then, the CPU 31 heats the fixing nip portion 22 to a softening point or more of the toner 17 by heating the heater 19 when the fixing film 15 is stopped. Accordingly, it is possible to prevent the accumulation of dirt of the toner on the surface of the pressure roller 21. Accordingly, it is possible to provide the image forming apparatus 28 capable of simultaneously preventing the short life of the fixing device 27 due to the recess portion 15*a* formed by the permanent deformation of the fixing film 15 and cleaning the surface of the pressure roller 21.

Additionally, in the embodiment, a case has been described in which the CPU 31 performs the heating of the heater 19 in the stop state of the motor 34 after the end of the print job, but the invention can be also applied to a case in which the heating is performed in the stop state of the motor 34 before the start of the print job.

Further, in the embodiment, the CPU 31 turns off the heater 19 in order to cool the end portion of the fixing nip portion 22 in the longitudinal direction in the post-rotation performed after the end of the print job.

When the temperature of the end portion of the fixing nip portion 22 in the longitudinal direction does not increase too much and the cooling operation is not necessary, however, as in the case in which the width of the recording material 16 (the length in the longitudinal direction of the fixing nip portion 22) is wide or the number of printed sheets is small, the fixing film 15 may be uniformly heated while turning on the motor 34 and the heater 19 after the end of the print job and then the heating may be performed in a stop state by turning off only the motor 34.

Second Embodiment

Next, a configuration of a second embodiment of the image forming apparatus according to the invention will be described with reference to FIGS. 12 to 15. Since components having the same configuration as those of the first embodiment are indicated by the same reference numerals or the same names with different reference numerals, a description thereof will be omitted.

Figure 12:
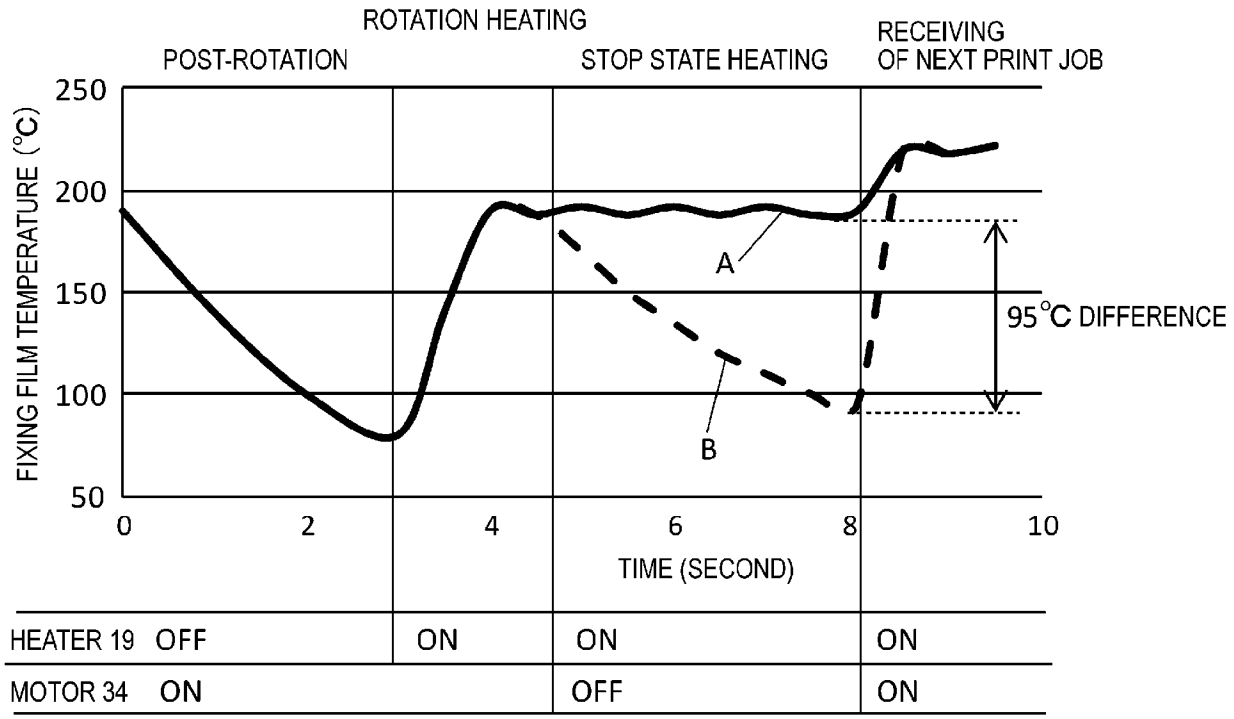
FIG. 12 is a diagram illustrating a transition of a temperature of the fixing film outside the fixing nip portion and a temperature of the fixing film inside the fixing nip portion when the heater is heated in a state in which rotational driving of the pressure roller continues for a predetermined time after the post-rotation of decreasing the temperature of the fixing film ends when the image forming apparatus is operated in an environment of 0° C.

In the embodiment, when the image forming apparatus 28 is operated in the environment of 0° C., the CPU 31 continues the rotational driving of the pressure roller 21 after the post-rotation of decreasing the temperature of the fixing film 15. FIG. 12 is a diagram illustrating a transition of the temperature of the fixing film 15 inside the fixing nip portion 22 and the temperature of the fixing film 15 outside the fixing nip portion 22 at the time of heating the heater 19 in that state.

A graph A of FIG. 12 indicates the temperature of the fixing film 15 inside the fixing nip portion 22. A graph B indicates the temperature of the fixing film 15 outside the fixing nip portion 22. The CPU 31 performs the post-rotation in order to cool the fixing nip portion until the temperature distribution of the fixing nip portion 22 in the longitudinal direction becomes flat after the end of the image forming operation. Then, the temperature of the fixing film 15 inside the fixing nip portion 22 indicated by the graph A and the temperature of the fixing film 15 outside the fixing nip portion 22 indicated by the graph B decrease by substantially the same temperature and the entire temperature of the fixing film 15 uniformly decreases.

The CPU 31 drives the heater 19 again for the purpose of increasing the temperature of the fixing film 15 in order to clean the surface of the pressure roller 21. In that case, the heater 19 is heated so that the temperature of the fixing film 15 inside the fixing nip portion 22 reaches a predetermined temperature while continuing the driving of the motor 34 and rotating the pressure roller 21 instead of stopping the driving of the motor 34.

When the image forming apparatus 28 is installed in the environment of 0° C., the ambient temperature of the image forming apparatus 28 decreases. In this case, a decrease in temperature due to heat radiation becomes fast in the temperature of the fixing film 15 having small thermal capacity. For that reason, when the rotational driving of the pressure roller 21 is stopped immediately after the temperature of the fixing film 15 reaches a predetermined temperature, the temperature of the fixing film 15 inside the fixing nip portion 22 is maintained at a predetermined temperature and the temperature of the fixing film 15 outside the fixing nip portion 22 decreases.

Accordingly, a temperature difference of the fixing film 15 inside and outside the fixing nip portion 22 becomes about 95° C. as illustrated in FIG. 12. Accordingly, when the rotational driving of the pressure roller 21 is started after receiving the next print job in a state in which the fixing film 15 is distorted, the recess portion 15*a* is formed by the permanent deformation of the fixing film 15.

Figure 13:
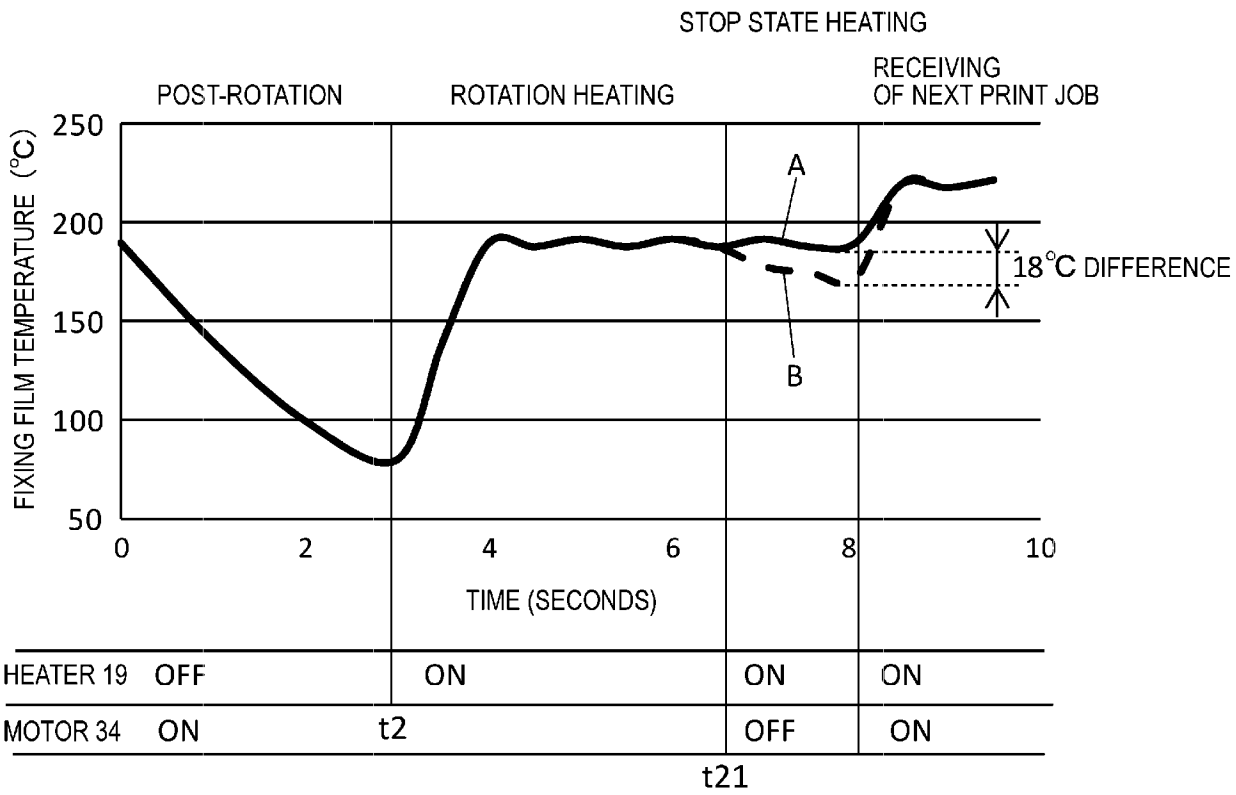
FIG. 13 is a diagram illustrating a transition of a temperature of the fixing film outside the fixing nip portion and a temperature of the fixing film inside the fixing nip portion when the heater is heated by extending a rotational driving time of the pressure roller after a post-rotation of decreasing the temperature of the fixing film ends when the image forming apparatus is operated in an environment of 0° C.

When the image forming apparatus 28 is operated in the environment of 0° C., the CPU 31 extends the rotational driving time of the pressure roller 21 after the post-rotation of decreasing the temperature of the fixing film 15 and heats the heater 19. FIG. 13 is a diagram illustrating a transition of the temperature of the fixing film 15 inside the fixing nip portion 22 and the temperature of the fixing film 15 outside the fixing nip portion 22 in that case.

A graph A of FIG. 13 indicates the temperature of the fixing film 15 inside the fixing nip portion 22. A graph B indicates the temperature of the fixing film 15 outside the fixing nip portion 22. During the post-rotation, the CPU 31 drives the motor 34 to rotate the pressure roller 21 while turning off the heater 19. For this reason, the temperature of the fixing film 15 inside the fixing nip portion 22 indicated by the graph A and the temperature of the fixing film 15 outside the fixing nip portion 22 indicated by the graph B decrease by substantially the same temperature. When the CPU 31 drives the heater 19 at the time t2 again, the heating is not performed while the driving of the motor 34 is stopped. Instead, the heating is performed so that the temperature of the fixing film 15 inside the fixing nip portion 22 indicated by the graph A reaches a predetermined temperature in a state in which the motor 34 is driven to rotate the pressure roller 21.

When the image forming apparatus 28 is installed in a low-temperature environment of 0° C., a decrease in temperature is promoted by heat radiation. Accordingly, after the temperature of the fixing film 15 inside the fixing nip portion 22 reaches a predetermined temperature, the predetermined temperature is maintained for a predetermined time and then the CPU 31 stops the driving of the motor 34 at the time t21. Accordingly, the temperature of the fixing film 15 inside the fixing nip portion 22 is maintained at a predetermined temperature and the temperature of the fixing film 15 outside the fixing nip portion 22 decreases.

At this time, a temperature difference starts to be generated between the temperature of the fixing film 15 inside the fixing nip portion 22 indicated by the graph A and the temperature of the fixing film 15 outside the fixing nip portion 22 indicated by the graph B. After the temperature of the fixing film 15 inside the fixing nip portion 22 reaches a predetermined temperature in a state in which the motor 34 is driven to rotate the pressure roller 21, however, the CPU 31 maintains the predetermined temperature for a predetermined time to warm the fixing film 15. Accordingly, as illustrated in FIG. 13, a temperature difference of the fixing film 15 inside and outside the fixing nip portion 22 can decrease to about 18° C. even in the low-temperature environment.

For that reason, stress caused by the expansion unevenness in the circumferential direction of the fixing film 15 is suppressed and the local distortion is not generated in the fixing film 15. Accordingly, the formation of the recess portion 15*a* by the permanent deformation of the fixing film 15 can be prevented even when the pressure roller 21 is driven by starting the next image forming operation.

Figure 14:
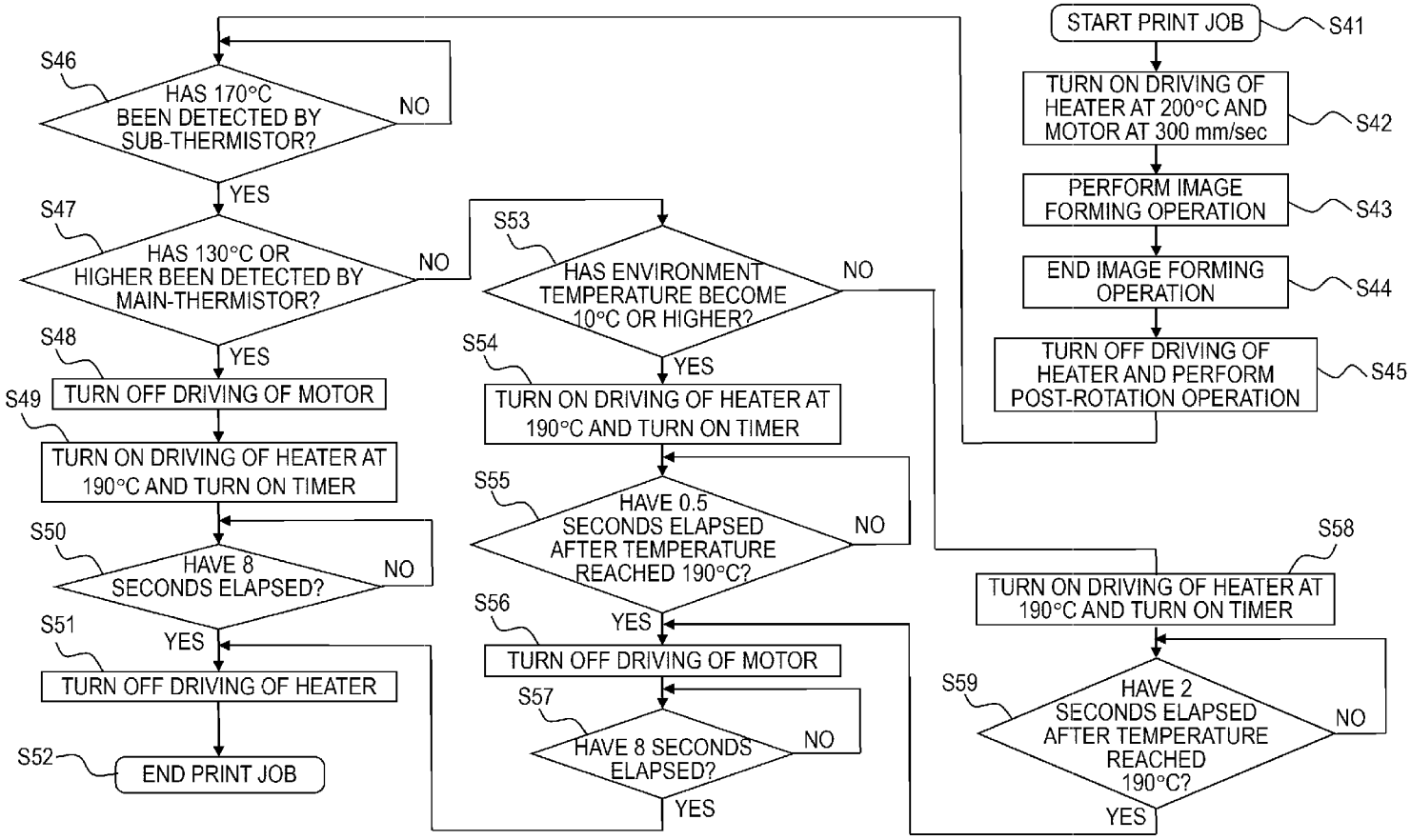
FIG. 14 is a flowchart illustrating an operation of an image forming apparatus of a second embodiment.

FIG. 14 is a flowchart illustrating an operation of the image forming apparatus 28 of the second embodiment. In the embodiment, since the temperature of the fixing film 15 inside the fixing nip portion 22 is substantially the same as the temperature of the heater 19, the CPU 31 predicts and controls the temperature of the fixing film 15 inside the fixing nip portion 22 from the detection results of the thermistors 18*a* and 18*b* that detect the temperature of the heater 19.

In Step S41 of FIG. 14, when the print job starts, the routine proceeds to Step S42 and the CPU 31 turns on the heater 19 and controls the temperature at 200° C. Then, the CPU turns on the driving of the motor 34 and rotates the pressure roller 21 at the circumferential velocity of 300 mm/sec. Then, the routine proceeds to Step S43 and the image forming operation starts.

Next, in Step S44, the routine proceeds to Step S45 after the end of the image forming operation and the CPU 31 turns off the driving of the heater 19 and continues the driving of the motor 34 to perform the post-rotation operation of rotating the pressure roller 21. Next, in Step S46, the CPU 31 determines whether the temperature detected by the thermistor 18*b* (the sub-thermistor) is 170° C. or less. The CPU 31 maintains the driving of the motor 34 in the ON state until the temperature detected by the thermistor 18*b* becomes 170° C. or less.

In Step S46, when the temperature detected by the thermistor 18*b* becomes 170° C. or less, the routine proceeds to Step S47. In Step S47, the CPU 31 checks the detection temperature of the thermistor 18*a* (the main thermistor) and determines whether the temperature detected by the thermistor 18*a* is 130° C. or greater. When the temperature detected by the thermistor 18*a* is 130° C. or greater, the routine proceeds to Step S48 and the CPU 31 turns off the driving of the motor 34.

Next, the routine proceeds to Step S49 and the CPU 31 turns on the driving of the heater 19 and controls the temperature at 190° C. At this time, the timer 39 is also turned on. Next, in Step S50, the CPU 31 determines whether 8 seconds have elapsed after turning on the timer 39. In Step S50, the CPU 31 continues the driving of the heater 19 until 8 seconds have elapsed after turning on the timer 39. In Step S50, when 8 seconds have elapsed after turning on the timer 39, the routine proceeds to Step S51 and the CPU 31 turns off the driving of the heater 19. Next, the routine proceeds to Step S52 and the print job ends.

In Step S46, the CPU 31 checks the temperature detected by the thermistor 18*a* (the main thermistor) when the temperature detected by the thermistor 18*b* (the sub-thermistor) becomes 170° C. or less. Then, in Step S47, when the temperature of the thermistor 18*a* (the main thermistor) becomes less than 130° C., the routine proceeds to Step S53.

In Step S53, the CPU 31 checks the temperature of the environment in which the image forming apparatus 28 is installed from the detection result of the environment temperature sensor 40, which is an environment detection portion detecting a main body installation environment, and determines whether the environment temperature is 10° C. or greater. In Step S53, when the temperature of the environment in which the image forming apparatus 28 is installed becomes 10° C. or greater, the routine proceeds to Step S54 and the CPU 31 turns on the driving of the heater 19 and controls the temperature at 190° C. At this time, the timer 39 is also turned on.

Next, the routine proceeds to Step S55 and the CPU 31 determines whether 0.5 seconds have elapsed after the temperature detected by the thermistor 18*a* (the main thermistor) reaches 190° C. The CPU 31 turns on the driving of the heater 19 until 0.5 seconds have elapsed after the temperature detected by the thermistor 18*a* reaches 190° C. and continues the rotation of the pressure roller 21 by driving the motor 34.

In Step S55, when 0.5 seconds have elapsed after the temperature detected by the thermistor 18*a* reaches 190° C., the routine proceeds to Step S56 and the CPU 31 turns off the driving of the motor 34 while turning on the driving of the heater 19. Next, the routine proceeds to Step S57 and the CPU 31 determines whether 8 seconds have elapsed after turning on the timer 39. The CPU 31 continues the driving of the heater 19 until 8 seconds have elapsed after turning on the timer 39.

In Step S57, when 8 seconds have elapsed after turning on the timer 39, the routine proceeds to Step S51 and the CPU 31 turns off the driving of the heater 19. Then, the routine proceeds to Step S52 and the print job ends. In Step S53, the CPU 31 checks the detection result of the environment temperature sensor 40, which is an environment detection portion checking a temperature of a periphery of the apparatus. Then, when the temperature of the environment in which the image forming apparatus 28 is installed becomes less than 10° C., the routine proceeds to Step S58 and the driving of the heater 19 is turned on and the temperature is controlled at 190° C. At this time, the timer 39 is also turned on. Next, the routine proceeds to Step S59 and the CPU 31 determines whether 2 seconds have elapsed after the detection result of the thermistor 18*a* (the main thermistor) reaches 190° C.

In Step S59, the CPU 31 continues the driving of the motor 34 while turning on the driving of the heater 19 until 2 seconds have elapsed after the detection result of the thermistor 18*a* reaches 190° C. In Step S59, when 2 seconds have elapsed after the detection result of the thermistor 18*a* reaches 190° C., the routine proceeds to Step S56 and the CPU 31 turns off the driving of the motor 34 while turning on the driving of the heater 19.

That is, the CPU 31 (the controller) refers to the detection result of the environment temperature sensor 40 (the environment detection portion) shown in Step S53. Then, as shown in Steps S55 and S59, the heating rotation time and the heating rotation temperature of the fixing film 15 are changed based on the detection result of the environment temperature sensor 40 (the environment detection portion) in the heating operation performed while rotating the fixing film 15 and the pressure roller 21 during the post-rotation performed after the end of the image forming operation and performed before the stop state heating operation.

Then, the routine proceeds to Step S57 and the CPU 31 continues the driving of the heater 19 until 8 seconds have elapsed after turning on the timer 39. In Step S57, when 8 seconds have elapsed after turning on the timer 39, the CPU 31 proceeds to Step S51 to turn off the driving of the heater 19 and proceeds to Step S52 to end the print job.

FIG. 15 is a diagram describing an effect for the recess portion 15*a* formed by the permanent deformation of the fixing film 15 when the image forming apparatus 28 is operated in the environment of 0° C. of the comparative example and the second embodiment.

As illustrated in FIG. 9, in the image forming apparatus 28 of the comparative example installed in the environment of 0° C., as shown in Steps S4 to S7, the driving of the motor 34 is stopped after the post-rotation operation after the end of the image forming operation. In that state, as shown in Step S8, the driving of the heater 19 is turned on and the temperature is controlled at 190° C. For this reason, as illustrated in FIG. 15, the temperature of the fixing film 15 inside the fixing nip portion 22 reaches 190° C., but the temperature of the fixing film 15 outside the fixing nip portion 22 continuously decreases to about 20° C.

For that reason, a temperature difference between temperatures inside and outside the fixing nip portion 22 becomes about 170° C. (=190° C.-about 20° C.). For this reason, the recess portion 15*a* is formed by the permanent deformation of the fixing film 15 when the rotational driving of the pressure roller 21 is started after receiving the next print job in a state in which the fixing film 15 is distorted.

As illustrated in FIG. 14, in the image forming apparatus 28 installed in the environment of 0° C., the driving of the heater 19 is turned on while rotating the pressure roller 21 after the post-rotation operation after the end of the image forming operation as shown in Steps S44 to S47, S53, and S58 in FIG. 14. Then, a temperature is controlled at 190° C. for a predetermined time. Accordingly, the fixing film 15 is uniformly warmed in the circumferential direction. Then, in Step S56, the heater 19 is heated while the driving of the motor 34 is stopped.

Accordingly, the temperature of the fixing film 15 inside the fixing nip portion 22 reaches 190° C., but the temperature of the fixing film 15 outside the fixing nip portion 22 once sufficiently warms to 190° C. and then decreases. For this reason, as illustrated in FIG. 15, the temperature of the fixing film 15 outside the fixing nip portion 22 at the time of heating the heater 19 during the stop of the pressure roller 21 becomes about 150° C. Accordingly, a temperature difference between temperatures inside and outside the fixing nip portion 22 can be suppressed to about 40° C. (=190° C.-about 150° C.). For this reason, when the rotational driving of the pressure roller 21 starts after receiving the next print job in a state in which the distortion of the fixing film 15 is prevented, the formation of the recess portion 15*a* by the permanent deformation of the fixing film 15 can be prevented.

Even when the installation environment of the image forming apparatus 28 is the low-temperature environment, the driving of the heater 19 is turned on while rotating the pressure roller 21 after the post-rotation operation after the end of the image forming operation and a temperature is controlled at a predetermined temperature so that the fixing film 15 can be uniformly and sufficiently warmed in the circumferential direction. Next, the heater 19 is heated while the pressure roller 21 is stopped.

Accordingly, a temperature difference of the fixing film 15 inside and outside the fixing nip portion 22 decreases and hence, the toner 17 adhered to the surface of the pressure roller 21 is melted while preventing the distortion of the fixing film 15. Accordingly, when the pressure roller 21 is rotationally driven after receiving the next print job, the formation of the recess portion 15*a* by the permanent deformation of the fixing film 15 is prevented. Further, the toner 17 adhering to the surface of the pressure roller 21 moves to the outer peripheral surface of the fixing film 15, and the surface of the pressure roller 21 can be cleaned. Since the other configurations are the same as those of the first embodiment, the same effect can be obtained.

Third Embodiment

Figure 16:
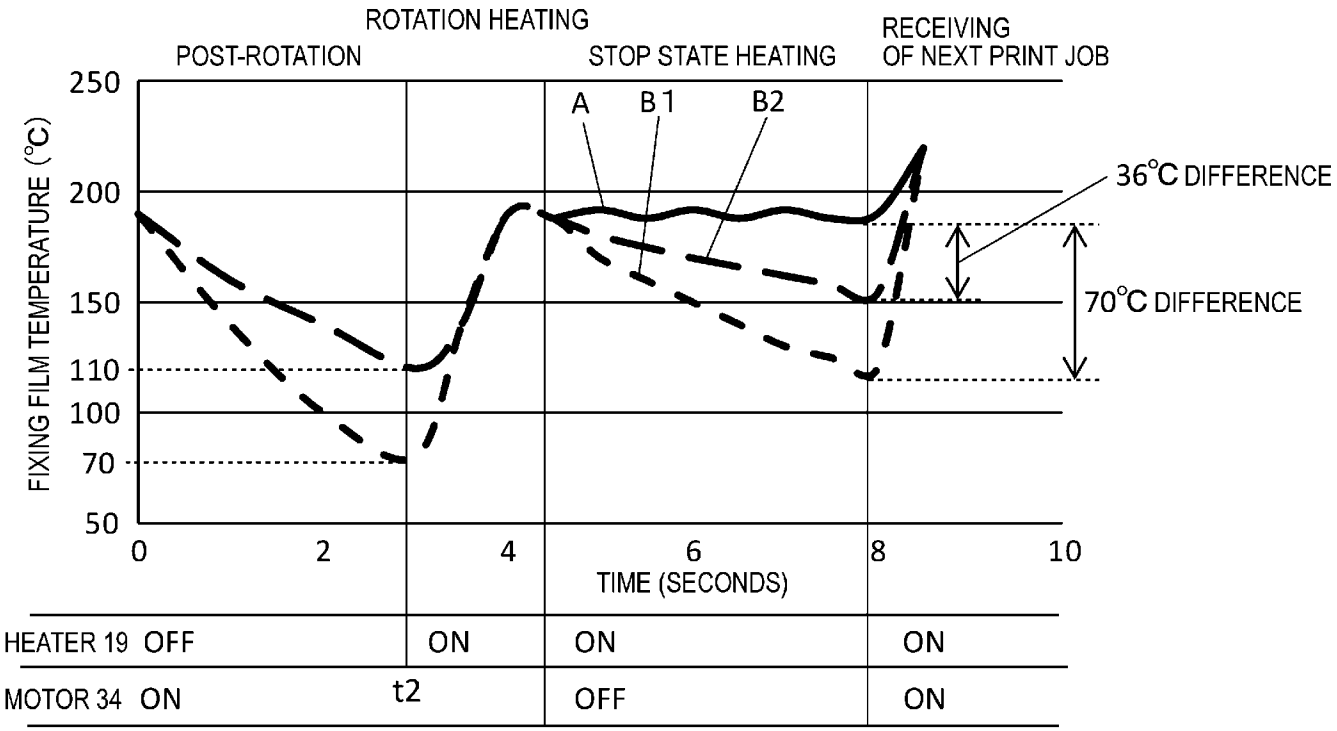
FIG. 16 is a diagram illustrating a transition of a temperature of a fixing film outside a fixing nip portion and a temperature of the fixing film inside the fixing nip portion when a heater is heated in a state in which rotational driving of a pressure roller continues for a predetermined time after a post-rotation of decreasing the temperature of the fixing film ends when the number of printed sheets is different in an image forming apparatus of a third embodiment.

Next, a configuration of a third embodiment of the image forming apparatus according to the invention will be described with reference to FIGS. 16 and 17. Since components having the same configuration as those of the above-described embodiments are indicated by the same reference numerals or the same names with different reference numerals, a description thereof will be omitted. FIG. 16 is a diagram illustrating a state in which the rotational driving of the pressure roller 21 continues for a predetermined time after the post-rotation of decreasing the temperature of the fixing film 15 when the number of printed sheets (the number of the recording materials 16 passing through the fixing nip portion 22) is different in the image forming apparatus 28 of the embodiment. That is, FIG. 16 is a diagram illustrating a transition of the temperature of the fixing film 15 inside the fixing nip portion 22 and the temperature of the fixing film 15 outside the fixing nip portion 22 at the time of heating the heater 19 in that state.

A graph A of FIG. 16 indicates the temperature of the fixing film 15 inside the fixing nip portion 22. Graphs B1 and B2 indicate the temperature of the fixing film 15 outside the fixing nip portion 22, a graph B1 indicates the temperature of the fixing film 15 outside the fixing nip portion 22 when the number of printed sheets is small, and a graph B2 indicates the temperature of the fixing film 15 outside the fixing nip portion 22 when the number of printed sheets is large.

During the post-rotation of cooling the fixing film 15 after the image forming operation, the CPU 31 drives the motor 34 to rotate the pressure roller 21 while turning off the heater 19. At the time t2, as shown in the graph B1, the temperature of the fixing film 15 outside the fixing nip portion 22 decreases by about 110° C. after a small number of recording materials 16 pass through the fixing nip portion 22. In contrast, as shown in the graph B2, the temperature of the fixing film 15 outside the fixing nip portion 22 decreases by about 70° C. after a large number of recording materials 16 pass through the fixing nip portion 22.

From this result, as shown in the graphs B1 and B2, the temperature change of the fixing film 15 cooled during the post-rotation becomes different in response to the history of the number of printed sheets of the print job. In this state, the CPU 31 drives the heater 19 again at the time t2. In that case, the heating is not performed while the driving of the motor 34 is stopped. The CPU 31 heats the heater 19 so that the temperature of the fixing film 15 inside the fixing nip portion 22 reaches a predetermined temperature while continuing the driving of the motor 34 and rotating the pressure roller 21.

When the number of the recording materials 16 having passed through the fixing nip portion 22 in the precedent print job is small, a decrease in temperature becomes large due to heat radiation. When the driving of the motor 34 is stopped immediately after the temperature of the fixing film 15 inside the fixing nip portion 22 reaches a predetermined temperature, the temperature of the fixing film 15 inside the fixing nip portion 22 is maintained at a predetermined temperature. Meanwhile, the temperature of the fixing film 15 outside the fixing nip portion 22 decreases. For this reason, as illustrated in FIG. 16, a temperature difference of the fixing film 15 inside and outside the fixing nip portion 22 becomes about 70° C.

Accordingly, when the rotational driving of the pressure roller 21 is started after receiving the next print job in a state in which the fixing film 15 is distorted, there is a risk of forming the recess portion 15*a* by the permanent deformation of the fixing film 15. When the number of the recording materials 16 having passed through the fixing nip portion 22 in the precedent print job is large, however, a decrease in temperature due to heat radiation becomes small. For this reason, even when the driving of the motor 34 is stopped immediately after the temperature of the fixing film 15 inside the fixing nip portion 22 reaches a predetermined temperature, a temperature difference of the fixing film 15 inside and outside the fixing nip portion 22 can be decreased to 36° C., as illustrated in FIG. 16.

For that reason, stress caused by the expansion unevenness in the circumferential direction of the fixing film 15 is suppressed and the local distortion is not generated in the fixing film 15. Accordingly, the formation of the recess portion 15*a* by the permanent deformation of the fixing film 15 can be prevented even when the pressure roller 21 is driven by starting the next image forming operation.

In this way, the heating condition due to the driving of the motor 34 after the post-rotation is changed in response to the number of the recording materials 16 having passed through the fixing nip portion 22 in the precedent print job condition and the temperature change of the fixing film 15 during the post-rotation of cooling the fixing film 15 after the image forming operation. Accordingly, the formation of the recess portion 15*a* by the permanent deformation of the fixing film 15 can be suppressed.

Figure 17:
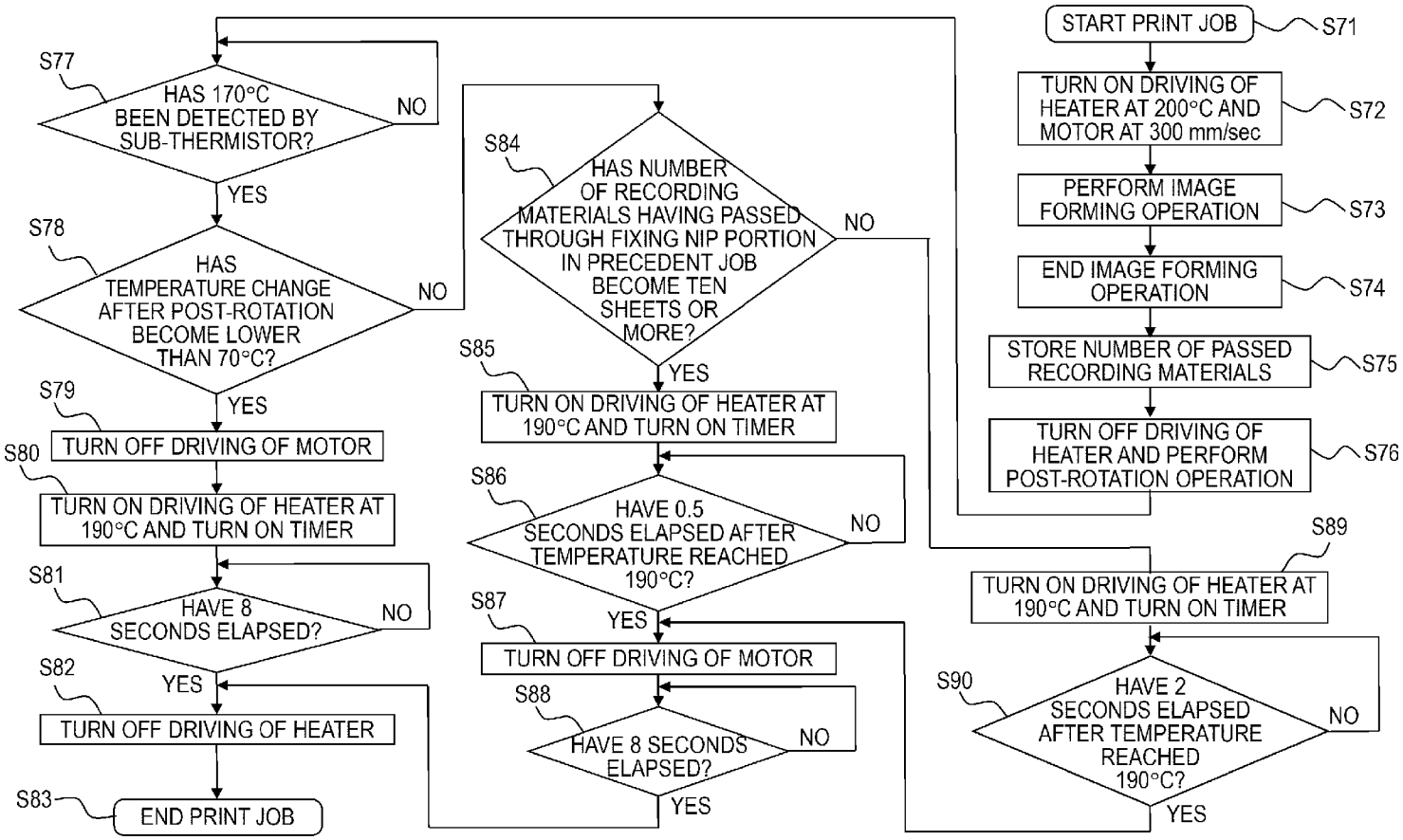
FIG. 17 is a flowchart illustrating an operation of the image forming apparatus of the third embodiment.

FIG. 17 is a flowchart illustrating an operation of the image forming apparatus 28 of the third embodiment. In the embodiment, since the temperature of the fixing film 15 inside the fixing nip portion 22 is substantially the same as the temperature of the heater 19, the CPU 31 predicts and controls the temperature of the fixing film 15 from the detection results of the thermistors 18*a* and 18*b* that detect the temperature of the heater 19.

In Step S71 of FIG. 17, the print job starts. Next, in Step S72, the CPU 31 turns on the heater 19 and controls the temperature at 200° C. Further, the driving of the motor 34 is turned on and the pressure roller 21 is rotationally driven at the circumferential velocity of 300 mm/sec.

Next, in Step S73, the image forming operation starts. Next, in Step S74, the image forming operation ends. Next, the routine proceeds to Step S75 and the CPU 31 stores the number of the recording materials 16 having passed through the fixing nip portion 22 in the precedent print job in the ROM 37. Next, the routine proceeds to Step S76 and the CPU 31 turns off the driving of the heater 19 and drives the motor 34 to perform the post-rotation operation.

Next, in Step S77, the CPU 31 determines whether the temperature detected by the thermistor 18*b* (the sub-thermistor) becomes 170° C. or less. In the above-described Step S, the CPU 31 maintains the driving of the motor 34 in the ON state until the temperature detected by the thermistor 18*b* becomes 170° C. or less. In Step S77, when the temperature detected by the thermistor 18*b* becomes 170° C. or less, the routine proceeds to Step S78 and the CPU 31 checks the temperature change detected by the thermistor 18*a* (the main thermistor) during the post-rotation.

In Step S78, the CPU 31 determines whether the temperature change detected by the thermistor 18*a* during the post-rotation is than 70° C. In Step S78, when the temperature change detected by the thermistor 18*a* is less than 70° C. during the post-rotation, the routine proceeds to Step S79 and the CPU 31 turns off the driving of the motor 34.

Next, the routine proceeds to Step S80 and the CPU 31 turns on the driving of the heater 19 and controls the temperature at 190° C. At this time, the timer 39 is also turned on. Next, the routine proceeds to Step S81 and the CPU 31 determines whether 8 seconds have elapsed after turning on the timer 39. In Step S81, the CPU 31 continues the driving of the heater 19 until 8 seconds have elapsed after turning on the timer 39. In Step S81, when 8 seconds have elapsed after turning on the timer 39, the routine proceeds to Step S82 and the CPU 31 turns off the driving of the heater 19. Next, the routine proceeds to Step S83 and the print job ends.

In Step S77, when the temperature detected by the thermistor 18*b* (the sub-thermistor) becomes 170° C. or less, the routine proceeds to Step S78. In Step S78, the CPU 31 checks the temperature change detected by the thermistor 18*a* (the main thermistor). When the temperature change detected by the thermistor 18*a* is 70° C. or greater, the routine proceeds to Step S84 and the number of the recording materials 16 having passed through the fixing nip portion 22 in the precedent print job is checked. Then, it is determined whether the number of the recording materials 16 having passed through the fixing nip portion 22 in the precedent print job is ten sheets or more.

That is, the CPU 31 (the controller) determines the state of the temperature of the fixing film 15 from the following information. The determination is made based on one or more of the temperature of the fixing film 15 during the post-rotation performed after the end of the image forming operation and the temperature change of the fixing film 15 during the post-rotation performed after the end of the image forming operation.

In Step S84, when the number of the recording materials 16 having passed through the fixing nip portion 22 in the precedent print job is ten sheets or more, the routine proceeds to Step S85 and the CPU 31 turns on the driving of the heater 19 and controls the temperature at 190° C. At this time, the timer 39 is also turned on.

Next, the routine proceeds to Step S86 and the CPU 31 determines whether 0.5 seconds have passed after the temperature detected by the thermistor 18*a* (the main thermistor) reaches 190° C. The CPU 31 continues the driving of the motor 34 while turning on the driving of the heater 19 until 0.5 seconds have elapsed after the temperature detected by the thermistor 18*a* reaches 190° C. In Step S86, when 0.5 seconds have elapsed after the temperature detected by the thermistor 18*a* reaches 190° C., the routine proceeds to Step S87. In Step S87, the CPU 31 continues the driving of the heater 19 and turns off the driving of the motor 34.

Next, the routine proceeds to Step S88 and the CPU 31 determines whether 8 seconds have elapsed after turning on the timer 39. The CPU 31 continues the driving of the heater 19 until 8 seconds have elapsed after turning on the timer 39. In Step S88, when 8 seconds have elapsed after turning on the timer 39, the routine proceeds to Step S82. In Step S82, the CPU 31 turns off the driving of the heater 19. Next, the routine proceeds to Step S83 and the print job ends.

In Step S84, the CPU 31 checks the number of the recording materials 16 having passed through the fixing nip portion 22 in the precedent print job. Then, when the number of the recording materials is less than ten sheets, the routine proceeds to Step S89 and the CPU 31 turns on the driving of the heater 19 and controls the temperature at 190° C. At this time, the timer 39 is also turned on.

Next, the routine proceeds to Step S90 and the CPU 31 determines whether 2 seconds have elapsed after the temperature detected by the thermistor 18*a* (the main thermistor) reaches 190° C. The CPU 31 continues the driving of the motor 34 while turning on the driving of the heater 19 until 2 seconds have elapsed after the temperature detected by the thermistor 18*a* reaches 190° C. In Step S90, when 2 seconds have elapsed after the temperature detected by the thermistor 18*a* reaches 190° C., the routine proceeds to Step S87 and the CPU 31 continues the driving of the heater 19 and turns off the driving of the motor 34.

Next, in Step S88, the CPU 31 continues the driving of the heater 19 until 8 seconds have elapsed after the timer 39 is turned on. In Step S88, when 8 seconds have elapsed after the timer 39 is turned on, the CPU 31 proceeds to Step S82 and turns off the driving of the heater 19. Next, the routine proceeds to Step S83 and the print job ends.

In the embodiment, a temperature is controlled at a predetermined temperature for a predetermined time while rotating the pressure roller 21 after the post-rotation operation performed after the end of the image forming operation in response to the history of the number of printed sheets of the print job. Accordingly, the fixing film 15 is sufficiently and uniformly warmed in the circumferential direction. Next, the heater 19 is heated while the pressure roller 21 is stopped. Accordingly, a temperature difference between temperatures inside and outside the fixing nip portion 22 decreases and hence, the toner 17 adhered to the surface of the pressure roller 21 can be melted while preventing the distortion of the fixing film 15.

Accordingly, the formation of the recess portion 15*a* by the permanent deformation of the fixing film 15 can be prevented even when the pressure roller 21 is rotationally driven after receiving the next print job. Further, the toner 17 adhering to the surface of the pressure roller 21 moves to the outer peripheral surface of the fixing film 15, and the surface of the pressure roller 21 can be cleaned. Since the other configurations are the same as those of the above-described embodiments, the same effect can be obtained.

Fourth Embodiment

Figure 18:
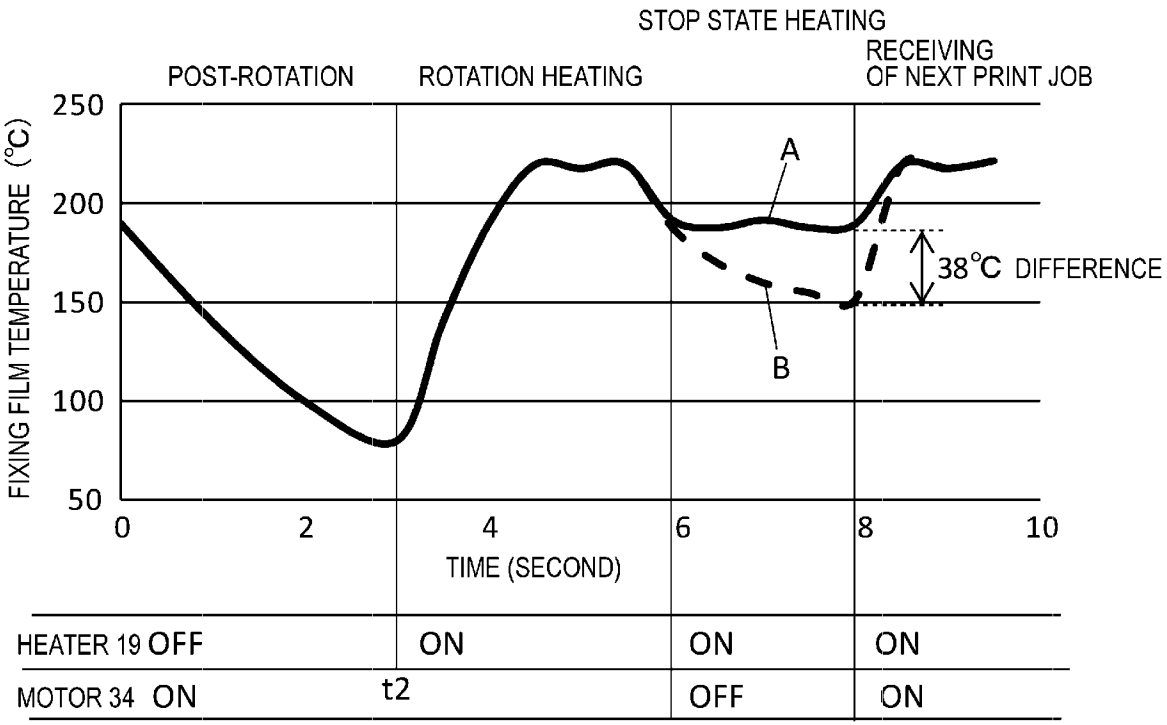
FIG. 18 is a diagram illustrating a transition of a temperature of a fixing film outside a fixing nip portion and a temperature of the fixing film inside the fixing nip portion when a heater is heated by changing a control temperature of the heater in a state in which rotational driving of a pressure roller continues for a predetermined time after a post-rotation of decreasing the temperature of the fixing film ends in an image forming apparatus of a fourth embodiment.

Next, a configuration of a fourth embodiment of the image forming apparatus according to the invention will be described with reference to FIGS. 18 and 19. Since components having the same configuration as those of the above-described embodiments are indicated by the same reference numerals or the same names with different reference numerals, a description thereof will be omitted. In the image forming apparatus 28 of the embodiment, the rotational driving of the pressure roller 21 continues for a predetermined time after the post-rotation of decreasing the temperature of the fixing film 15. FIG. 18 is a diagram illustrating a transition of the temperature of the fixing film 15 inside the fixing nip portion 22 and the temperature of the fixing film 15 outside the fixing nip portion 22 at the time of performing the heating by changing the temperature of the heater 19 in that state.

A graph A of FIG. 18 indicates the temperature of the fixing film 15 inside the fixing nip portion 22. A graph B indicates the temperature of the fixing film 15 outside the fixing nip portion 22. The CPU 31 turns off the heater 19 in order to cool the fixing nip portion 22 until the temperature distribution of the fixing nip portion 22 in the longitudinal direction becomes flat after the end of the image forming operation and performs the post-rotation of rotationally driving the pressure roller 21 by turning on the driving of the motor 34. Then, the temperature of the fixing film 15 inside the fixing nip portion 22 indicated by the graph A and the temperature of the fixing film 15 outside the fixing nip portion 22 indicated by the graph B decrease by substantially the same and the entire temperature of the fixing film 15 uniformly decreases.

When the CPU 31 drives the heater 19 at the time t2 again, the heater 19 is heated so that the temperature of the fixing film 15 inside the fixing nip portion 22 reaches a predetermined temperature while rotating the pressure roller 21 by driving the motor 34 instead of performing the heating while stopping the motor 34. The CPU 31 sets a control temperature at the time of heating the heater 19 while rotating the pressure roller 21 by driving the motor 34 to be greater than a control temperature at the time of stopping the driving of the motor 34. Accordingly, as illustrated in FIG. 18, a temperature difference of the fixing film 15 inside and outside the fixing nip portion 22 can be decreased to 38° C. even when the driving of the motor 34 is stopped.

For that reason, stress caused by the expansion unevenness in the circumferential direction of the fixing film 15 is suppressed and the local distortion is not generated in the fixing film 15. Accordingly, the formation of the recess portion 15*a* by the permanent deformation of the fixing film 15 can be prevented even when the pressure roller 21 is driven by starting the next image forming operation. From this result, it is understood that the formation of the recess portion 15*a* by the permanent deformation of the fixing film 15 is suppressed when the control temperature during the heating rotation after the post-rotation is changed.

Figure 19:
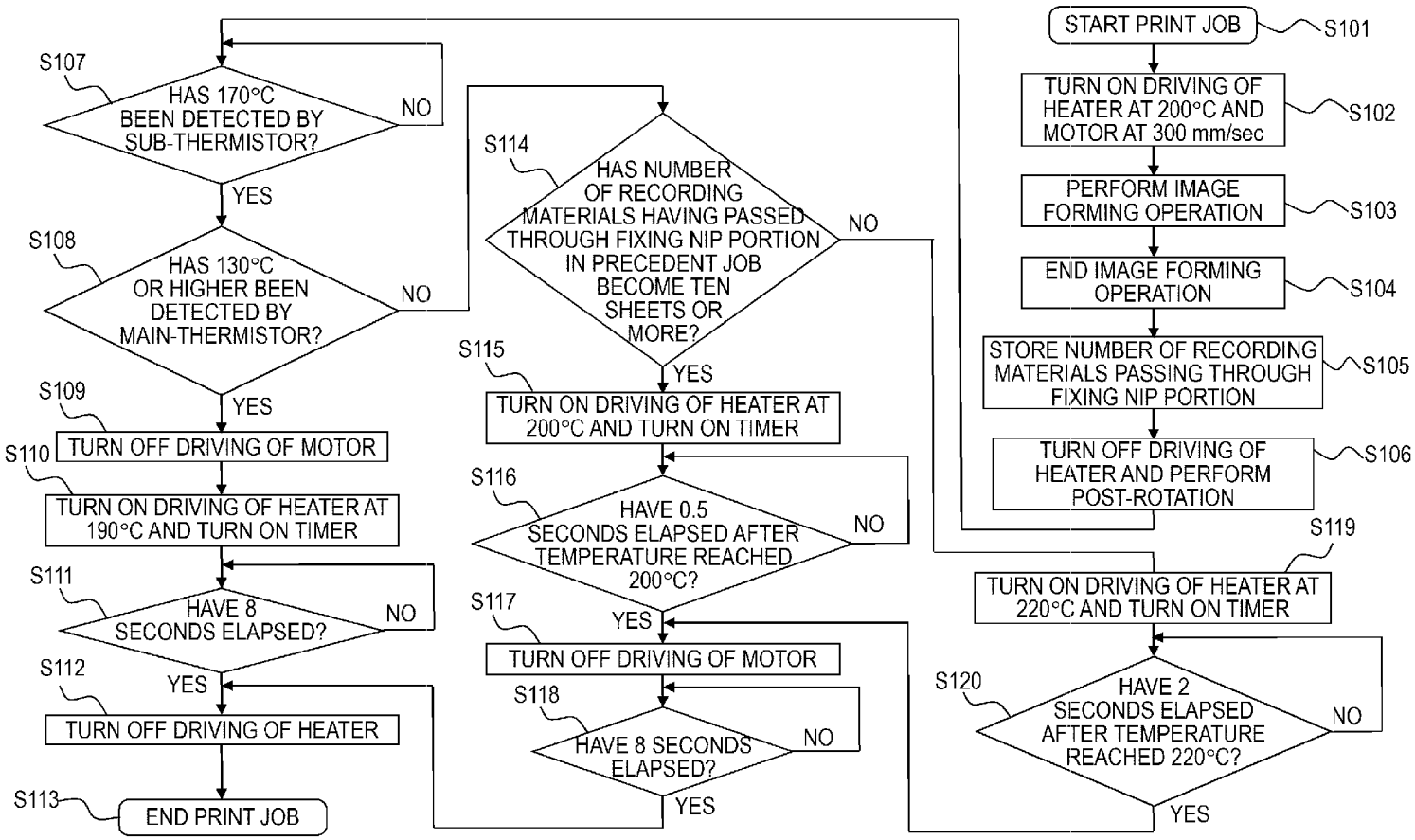
FIG. 19 is a flowchart illustrating an operation of the image forming apparatus of the fourth embodiment.

FIG. 19 is a flowchart illustrating an operation of the image forming apparatus 28 of the embodiment. In the embodiment, since the temperature of the fixing film 15 inside the fixing nip portion 22 is substantially the same as the temperature of the heater 19, the CPU 31 predicts and controls the temperature of the fixing film 15 from the detection results of the thermistors 18*a* and 18*b* that detect the temperature of the heater 19.

In Step S101 of FIG. 19, the print job starts. Next, in Step S102, the CPU 31 turns on the driving of the heater 19 and controls the temperature at 200° C. Further, the driving of the motor 34 is turned on and the pressure roller 21 is rotationally driven at the circumferential velocity of 300 mm/sec. Next, in Step S103, the image forming operation starts.

Next, in Step S104, the image forming operation ends. Next, the routine proceeds to Step S105 and the CPU 31 stores the number of the recording materials 16 having passed through the fixing nip portion 22 in the precedent print job in the RAM 38. The RAM 38 is configured as a storage portion that stores the image forming operation. Next, the routine proceeds to Step S106 and the CPU 31 turns off the driving of the heater 19 and drives the motor 34 to perform the post-rotation operation.

Next, in Step S107, the CPU 31 determines whether the temperature detected by the thermistor 18*b* (the sub-thermistor) becomes 170° C. or less. In Step S107, the CPU 31 maintains the driving of the motor 34 in the ON state until the temperature detected by the thermistor 18*b* becomes 170° C. or less.

In Step S107, when the temperature detected by the thermistor 18*b* becomes 170° C. or less, the routine proceeds to Step S108. In Step S108, the CPU 31 checks the temperature detected by the thermistor 18*a* (the main thermistor) and determines whether the temperature detected by the thermistor 18*a* is 130° C. or greater. In Step S108, when the temperature detected by the thermistor 18*a* is 130° C. or greater, the routine proceeds to Step S109 and the CPU 31 turns off the driving of the motor 34.

Next, the routine proceeds to Step S110 and the CPU 31 turns on the driving of the heater 19 and controls the temperature at 190° C. At this time, the timer 39 is also turned on. Next, the routine proceeds to Step S111 and the CPU 31 determines whether 8 seconds have elapsed after turning on the timer 39. The CPU 31 continues the driving of the heater 19 until 8 seconds have elapsed after turning on the timer 39. In Step S111, when 8 seconds have elapsed after turning on the timer 39, the routine proceeds to Step S112 and the CPU 31 turns off the driving of the heater 19. Next, the routine proceeds to Step S113 and the print job ends.

In Step S107, when the temperature detected by the thermistor 18*b* (the sub-thermistor) becomes 170° C. or less, the routine proceeds to Step S108. In Step S108, the CPU 31 checks the temperature detected by the thermistor 18*a* (the main thermistor). When the temperature detected by the thermistor 18*a* is less than 130° C., the routine proceeds to Step S114. In Step S114, the CPU 31 checks the number of the recording materials 16 having passed through the fixing nip portion 22 in the precedent print job and determines whether the number of the recording materials 16 having passed through the fixing nip portion 22 in the precedent print job is ten sheets or more.

In Step S114, when the number of the recording materials 16 having passed through the fixing nip portion 22 in the precedent print job is ten sheets or more, the routine proceeds to Step S115 and the CPU 31 turns on the driving of the heater 19 and controls the temperature at 200° C. At this time, the timer 39 is also turned on. Next, the routine proceeds to Step S116 and the CPU 31 determines whether 0.5 seconds have elapsed after the temperature detected by the thermistor 18*a* (the main thermistor) reaches 200° C. The CPU 31 continues the driving of the motor 34 while turning on the driving of the heater 19 until 0.5 seconds have elapsed after the temperature detected by the thermistor 18*a* reaches 200° C.

That is, the CPU 31 (the controller) refers to the state of the temperature of the fixing film 15 during the post-rotation performed after the end of the image forming operation as shown in Step S108. Then, the heating rotation time of the fixing film 15 during the post-rotation performed after the end of the image forming operation is set to be long as the temperature of the fixing film 15 decreases based on the determination as shown in Step S116.

Further, the CPU 31 (the controller) refers to the state of the temperature of the fixing film 15 during the post-rotation performed after the end of the image forming operation as shown in Step S108. Then, the following control is performed as it is determined that the temperature of the fixing film 15 is low. As shown in Step S115, the control temperature (200° C.) of the fixing film 15 during the post-rotation performed after the end of the image forming operation is set to be greater than the control temperature (190° C.) at the time of stopping the fixing film 15 as shown in Step S110.

In Step S116, when 0.5 seconds have elapsed after the temperature detected by the thermistor 18*a* reaches 200° C., the routine proceeds to Step S117 and the CPU 31 maintains the driving of the heater 19 in the ON state and turns off the driving of the motor 34.

Next, in Step S118, the CPU 31 determines whether 8 seconds have elapsed after turning on the timer 39. The CPU 31 continues the driving of the heater 19 until 8 seconds have elapsed after turning on the timer 39. In Step S118, when 8 seconds have elapsed after turning on the timer 39, the routine proceeds to Step S112 and the CPU 31 turns off the driving of the heater 19. Next, the routine proceeds to Step S113 and the print job ends.

In Step S114, the CPU 31 checks the number of the recording materials 16 having passed through the fixing nip portion 22 in the precedent print job. Then, when the number of the recording materials is less than ten sheets, the routine proceeds to Step S119 and the CPU 31 turns on the driving of the heater 19 and controls the temperature at 220° C. At this time, the timer 39 is also turned on.

That is, the CPU 31 (the controller) increases the heating temperature of the fixing film 15 as the temperature of the fixing film 15 (the rotating member) decreases. Next, the routine proceeds to Step S120 and the CPU 31 determines whether 2 seconds have elapsed after the temperature detected by the thermistor 18*a* (the main thermistor) reaches 220° C. In Step S120, the CPU 31 continues the driving of the heater 19 and the motor 34 until 2 seconds have elapsed after the temperature detected by the thermistor 18*a* (the main thermistor) reaches 220° C.

In Step S120, when 2 seconds have elapsed after the temperature detected by the thermistor 18*a* (the main thermistor) reaches 220° C., the routine proceeds to Step S117 and the CPU 31 maintains the driving of the heater 19 in the ON state and turns off the driving of the motor 34. That is, the CPU 31 (the controller) change the heating rotation time and the heating rotation temperature of the fixing film 15 during the post-rotation performed after the end of the image forming operation from the storage result (the number of printed sheets) of the RAM 38 (the storage portion) shown in Step S114.

Next, the routine proceeds to Step S118 and the CPU 31 continues the driving of the heater 19 until 8 seconds have elapsed after the timer 39 is turned on. In Step S118, when 8 seconds have elapsed after the timer 39 is turned on, the routine proceeds to Step S112 and the CPU 31 turns off the driving of the heater 19. Next, the routine proceeds to Step S113 and the print job ends.

In this way, the CPU 31 (the controller) changes the rotation time and the heating temperature of the fixing film 15 and the pressure roller 21 based on the number of printed sheets of the print job corresponding to the history information in the heating operation performed while rotating the fixing film 15 and the pressure roller 21 and performed before the stop state heating operation. In the embodiment, the control temperature or the temperature control time is changed while rotating the pressure roller 21 after the post-rotation operation performed after the end of the image forming operation in response to the history of the number of printed sheets of the print job.

Accordingly, the fixing film 15 is sufficiently and uniformly warmed in the circumferential direction and then the heater 19 is heated while the pressure roller 21 is stopped. Accordingly, since a temperature difference of the fixing film 15 inside and outside the fixing nip portion 22 decreases, it is possible to melt the toner 17 adhered to the surface of the pressure roller 21 while preventing the distortion of the fixing film 15.

Accordingly, the formation of the recess portion 15*a* by the permanent deformation of the fixing film 15 is prevented at the time of rotationally driving the pressure roller 21 after receiving the next print job. Further, the toner 17 adhering to the surface of the pressure roller 21 moves to the outer peripheral surface of the fixing film 15, and the surface of the pressure roller 21 can be cleaned.

In addition, the same effect can be obtained even when the control temperature or the temperature control time is changed while rotating the pressure roller 21 after the post-rotation operation performed after the end of the image forming operation in response to the detection result of the environment temperature sensor 40 as well as the history of the number of printed sheets of the print job. Since the other configurations are the same as those of the above-described embodiments, the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus that fixes a toner image, formed on a recording material, to the recording material by applying heat and pressure, the image forming apparatus comprising:

a rotating unit;

a pressing portion configured to form a nip portion with the rotating unit for nipping the recording material to be conveyed;

a heating portion configured to heat the nip portion, formed by the rotating unit and the pressing portion, by performing a heating operation; and a controller configured to change the rotating unit between a rotating state, in which the rotating unit rotates, and a stop state, in which the rotating unit stops, and to control a temperature of the heating portion to be a predetermined temperature by performing the heating operation, wherein the controller performs, in order, (i) a non-heating rotating process of setting the rotating unit in the rotating state without controlling the temperature of the heating portion to be the predetermined temperature by performing the heating operation, after fixing the toner image on the recording material, (ii) a heating rotating process of controlling the temperature of the heating portion to be the predetermined temperature by performing the heating operation while setting the rotating unit in the rotating state, and (iii) a heating stopping process of controlling the temperature of the heating portion to be the predetermined temperature by performing the heating operation while setting the rotating unit in the stop state, the controller stopping the heating operation in the heating stopping process after a predetermined period.

2. The image forming apparatus according to claim 1, wherein the controller is further configured to select (i) a first mode, in which the non-heating rotating process is performed after the fixing of the toner image to the recording material, the heating rotating process is performed, and then the heating stopping process is performed after the heating rotating process, and (ii) a second mode, in which the non-heating rotating process is performed after the fixing of the toner image to the recording material, the heating rotating process is performed, and then the heating stopping process is performed without performing the heating rotating process.

3. The image forming apparatus according to claim 1, wherein the controller performs control such that the rotation of the rotating unit starts ahead of the heating of the rotating unit at a time of performing the heating rotating process.

4. The image forming apparatus according to claim 1, further comprising a detection portion that detects a temperature of the heating portion, wherein the controller performs the heating stopping process after performing the heating rotating process when the temperature of the heating portion is less than a predetermined threshold temperature, which is voluntarily set.

5. The image forming apparatus according to claim 1, further comprising an end portion temperature detection portion that detects a temperature of an end portion of the rotating unit in a rotation axis direction, wherein the controller continues the non-heating rotating process until the temperature detected by the end portion temperature detection portion is equal to or less than a threshold temperature, which is voluntarily set.

6. The image forming apparatus according to claim 1, further comprising a detection portion that detects a temperature of the heating portion, wherein the controller changes a rotation time and a heating temperature of the heating portion based on the temperature of the heating portion, detected by the detection portion, at a time when the heating rotating process starts.

7. The image forming apparatus according to claim 6, wherein the controller extends a time in which the rotating unit is heated in a rotation state as the temperature of the heating portion decreases at a time when the heating rotating process starts.

8. The image forming apparatus according to claim 6, wherein the controller increases a rotating unit heating temperature as the temperature of the heating portion decreases at a time when the heating rotating process starts.

9. The image forming apparatus according to claim 1, wherein a rotation time of the rotating unit during the heating rotating process is a time in which the rotating unit rotates once or more.

10. The image forming apparatus according to claim 1, further comprising a storage portion that stores history information of an image forming operation, wherein the controller changes a rotation time and a heating temperature of the rotating unit during the heating rotating process based on the history information.

11. The image forming apparatus according to claim 1, further comprising an environment detection portion that detects a temperature in a periphery of the image forming apparatus, wherein the controller changes a rotation time and a heating temperature of the rotating unit during the heating rotating process based on a detection result of the environment detection portion during the heating rotating process.

12. The image forming apparatus according to claim 1, wherein the rotating unit includes a film-shaped structure, and a base film thickness of the film-shaped structure is 100 μm or less.

13. The image forming apparatus according to claim 12, wherein a base material of the film-shaped structure is metal.

14. The image forming apparatus according to claim 1, wherein the rotating unit is a cylindrical film.

15. An image forming apparatus that fixes a toner image, formed on a recording material, to the recording material by applying heat and pressure, the image forming apparatus comprising:

a rotating unit;

a pressing portion configured to form a nip portion with the rotating unit for nipping the recording material to be conveyed;

a heating portion configured to heat the nip portion, formed by the rotating unit and the pressing portion, by performing a heating operation; and a controller configured to select to perform one mode from a plurality of modes including a first mode and a second mode, wherein in the first mode, the controller performs, in order, (i) a non-heating rotating process of setting the rotating unit in a rotating state without controlling a temperature of the heating portion to be a predetermined temperature by performing the heating operation, after fixing the toner image on the recording material, (ii) a heating rotating process of controlling the temperature of the heating portion to be the predetermined temperature by performing the heating operation while setting the rotating unit in the rotating state, in which the rotating unit rotates, and (iii) a heating stopping process of controlling the temperature of the heating portion to be the predetermined temperature by performing the heating operation while setting the rotating unit in a stop state, in which the rotating unit stops, in the second mode, the non-heating rotating process is performed, after fixing the toner image on the recording material, and then the heating stopping process is performed without performing the heating rotating process, and in both the first mode and the second mode, the controller stops the heating operation in the heating stopping process after a predetermined period.

16. The image forming apparatus according to claim 15, wherein the rotating unit is a cylindrical film.

* * * * *